US007909585B2

(12) United States Patent
Clancy

(10) Patent No.: US 7,909,585 B2
(45) Date of Patent: Mar. 22, 2011

(54) NATURAL GAS COMPRESSOR AND A SYSTEM FOR OPERATING THE SAME

(75) Inventor: Sandy Albert Clancy, Paradise (CA)

(73) Assignee: Lyle John Watts, Rochan Sands, Alberta (CA)

( * ) Notice: Subject to any disclaimer, the term of this patent is extended or adjusted under 35 U.S.C. 154(b) by 1028 days.

(21) Appl. No.: 11/728,996

(22) Filed: Mar. 28, 2007

(65) Prior Publication Data

US 2007/0269317 A1 Nov. 22, 2007

(30) Foreign Application Priority Data

May 19, 2006 (CA) ..... 2544366

(51) Int. Cl.
*E21B 21/06* (2006.01)

(52) U.S. Cl. ..... 417/313; 166/75.12; 166/276

(58) Field of Classification Search ..... 417/313; 166/75.12, 276
See application file for complete search history.

(56) References Cited

U.S. PATENT DOCUMENTS 5,025,860 A * 6/1991 Mandrin ..... 166/267
5,117,908 A * 6/1992 Hofmann ..... 166/267
7,255,540 B1 * 8/2007 Cooper ..... 417/234

OTHER PUBLICATIONS

Information regarding Brahma Compression, 2 pages dated at bottom Mar. 29, 2006 and Mar. 30, 2006.
Material from http://www.tornadotech.net/products/mobile_ompressors.html (Tornado Technologies Inc.) dated Mar. 30, 2006 (6 pages).
Information regarding Startec, 3 pages In total (2+1), dated Apr. 12, 2007.
Information regarding Enerflex 2500 Series, 1 page.
Corlac Product Information 9 pages.
Material from http://www.bidell.com/stockrecip.htm (Bidell Equipment) dated Mar. 30, 2006 (3 pages).

* cited by examiner

*Primary Examiner* — Devon C Kramer
*Assistant Examiner* — Philip Stimpert
(74) *Attorney, Agent, or Firm* — Frommer Lawrence & Haug LLP; Ronald R. Santucci

(57) ABSTRACT

A power engine natural gas compressor system to optimize the extraction of natural gas from a reservoir and related gathering systems. The system is controlled by a distributed control system, which is a computer readable program, and allows for humane machine interface allowing for a more efficient use of the available power supply resulting in increased efficiency. Through the use of an integrated control system the present invention achieves a precise control of the overall operation of the system, which would be impossible to achieve through manual manipulation. The system of the present invention is a system capable of multiple functions with minimal losses with respect to efficiency. Different from the compressors found in the market the system uses a sophisticated process and control system, and is constructed and arranged in such a way that someone with little to no training can operate and maintain it.

36 Claims, 17 Drawing Sheets

NATURAL GAS COMPRESSOR AND A SYSTEM FOR OPERATING THE SAME

This application claims priority benefits from Canadian Patent Application No. 2,544,366 filed May 19, 2006, the disclosure of which is hereby incorporated by reference.

FIELD OF THE INVENTION

This application is in the field of natural gas compressors.

BACKGROUND OF THE INVENTION

This invention relates to a power engine natural gas compressor system to optimize the extraction of natural gas from a reservoir and related gathering systems. The system is controlled by a distributed control system (DCS), which is a computer readable program, and allows for (HMI) humane machine interface. The DCS is integrated with a power engine computer system, which allows for diagnostics, control and data logging. Also, the system has been designed to allow for the easy removal of all parts in the event that maintenance is required. In other words, different from the compressors found in the market the system uses a sophisticated process and control system, and is constructed and arranged in such a way that someone with little to no training can operate and maintain it.

As known by those skilled in the art, some gas compressors use a hydraulic drive, however the configuration varies tremendously, and the final results achieved are most of the time completely different.

The Corlac QRNG (trademark) series is a basic unit which affords little guarantee of protection with respect to the equipment being run and cannot provide efficient utilization of power. The unit uses a hydraulic pump fitted with a sheave and use belts to turn the flywheel on the compressor. The hydraulic pump is an on/off unit with the speed being controlled by manual manipulation. Differently from the Corlac unit, the natural gas compressor of this invention is coupled via a direct drive system using a coupled arrangement between the compressor and the hydraulic pump. With the system of the present invention it is possible to control the hydraulic motor speed through an integrated control system, by using predetermined operational parameters with calculated tables to ensure that the speed and hp requirements are optimized at all times. Additionally, mechanical limitations can be imposed by limiting pressure and flows to the hydraulic system. Furthermore, the system of the present invention provides calculated control and protection to the equipment being run and ensures that the system never runs in adverse conditions that could cause damage to the compressor.

Other compressor systems found in the market, such as from Bidell Equipment, Brahma, Startec, Enerflex (trademark) and Compass Compression use a direct drive from the engine to the compressor and do not have the ability to run multiple operations at one time. Additionally these compressors of the prior art are not assembled in such a way as to allow for unskilled labor to perform maintenance and operations of the equipment. Differently from these systems, the present invention uses hydraulics to transfer power the compressor and associated equipment.

None of the compressor systems of the prior art have their components assembled up so that they can be unplugged or unbolted for removal without the need for technically skilled people. Additionally, the systems of the prior art do not use hydraulics extensively, which allows for multiple operations to be undertaken at one time.

SUMMARY OF THE INVENTION

The new system of the present invention enables the operation of multiple devices through the utilization of one power source. This allows for more efficient use of the available power supply resulting in increased efficiency. Through the use of an integrated control system the present invention achieves a precise control of the overall operation of the system, which would be impossible to achieve through manual manipulation. The system of the present invention is a system capable of multiple functions with minimal losses with respect to efficiency.

The present invention seeks to provide a natural gas compressor for optimizing the extraction of natural gas from a reservoir or associated gathering system, comprising in combination: a natural gas and liquids flow under pressure supply from a source; a separator, receiving the supply of gas and liquids flow under pressure by a first piping line and separating the natural gas and liquids flow into a gas flow and a liquids flow, the liquids flow directed to a drain and the gas flow directed to a second piping line; a water pump receiving the liquids flow from the drain by a draining line and conveying the liquids to any desired location; a compressor receiving the gas flow from the separator by the second piping line and compressing the gas; a compressor relief piping line, connected to the compressor for relieving any excessive pressure; an after-cooler receiving the compressed gas flow from the compressor by a third piping line, cooling the compressed gas flow and dividing the gas flow into a first cooled gas flow line, a second cooled gas flow line and a third cooled gas flow line; an engine, receiving the first cooled gas flow line from the after-cooler by a sixth piping line and generating power; an end-user connection receiving the second cooled gas flow line from the after-cooler by a fourth piping line; a low-pressure recycle line receiving the third cooled gas flow from the after-cooler by a fifth piping line and conveying to the end-user connection; an exhaust system exhausting the combustion gases from the engine; a hydraulic liquids supply from a source; a hydraulic pump, connected to the hydraulic liquids supply and to the engine, receiving power from the engine and transferring hydraulic pressure to the a seventh piping line; a hydraulic motor, connected to the hydraulic liquids supply, to the hydraulic pump, to the engine and controlled by an actuated valve, receiving hydraulic pressure from the hydraulic pump by the seventh piping line and power from the engine; transferring power to the compressor, to the after-cooler and to the water pump by a hydraulic pumping system; a sensor and actuator assembly connected to predetermined and specific locations in the compressor; a valve assembly linked to the first, second, third, fourth, fifth, sixth and seventh piping line, to the separator, to the water pump, to the compressor, to the after-cooler, to the low-pressure line, to the engine, to the hydraulic motor and to the hydraulic pumping system; the valve assembly constructed and arranged to automatically controlling and operating the compressor within predetermined ranges of pressure, temperature and flow volume; a hydraulic pilot pump, connected to the hydraulic liquids supply and to the engine, receiving power from the engine and actuating the valve assembly; a computer readable system linked to the sensor and actuator and valve assemblies, to the hydraulic pump, to the hydraulic motor, to the engine, to the separator, to the compressor, to the after-cooler, to the low-pressure line, and to the hydraulic pumping system; the computer readable system constructed and arranged to allow for human-machine interface, and to simultaneously run and control the overall operation of the compressor system, and to allow for the operation of all components through the utilization of one power generating engine source, wherein the piping lines, the valve assembly, the hydraulic pump, the hydraulic motor, the engine, the separator, the compressor, the after-cooler and the low-pressure line are constructed and arranged to allow for a safe and easy removal and installation of any specific component and to allow for multiple functions to be undertaken at one time, accommodating a multitude of operational conditions.

The present invention also seeks to provide a system for operating a natural gas compressor as described above, the system comprising: providing a gas and liquid flow under pressure to a separator; separating the gas and the liquid in the flow; conveying the separated gas flow from the separator to a compressor; conveying the separated water flow from the separator to a water pump; conveying the separated water flow from the water pump to any desired location, draining any remaining water; compressing the gas; conveying the compressed gas flow from the compressor to an after-cooler; conveying a fist flow of the separated gas flow from the after-cooler to an engine; conveying a second and a third flow of the separated gas flow to an end user connection; supplying hydraulic liquid to an hydraulic pump; transferring hydraulic power from the hydraulic pump to a hydraulic motor and to a hydraulic pilot pump (112); transferring hydraulic power from the hydraulic motor to the compressor; obtaining operational information from a sensor assembly in the system and transmitting to a computer readable program; the computer readable program comparing the obtained operational information with a predetermined operational parameters; the program activating a valve assembly, actuated by the hydraulic pilot pump (112); the valve assembly activating an actuator assembly and automatically controlling and operating the system.

The invention will be now described in detail with reference to the preferred embodiment showed in the attached drawings as follows.

DETAILED DESCRIPTION OF THE INVENTION

The invention consists of a natural gas compressor, designed to optimize the extraction of natural gas from the reservoir or associated gathering system. In the preferred embodiment of this invention an engine generates power and transfers the power generated using a hydraulic system. The hydraulic system is used to drive two natural gas compressors, a natural gas after-cooler and a water pump, all of them controlled by a valve assembly.

For the preferred embodiment of this invention both compressors (400) and (500) are reciprocating compressors. The system is controlled by a distributed control system (DCS), which is a computer readable program, including the engine (300) which is controlled through a connector (such as the J1939 CAN from Pyramid Solutions) between the DCS and the ignition control module of the engine (such as the Ford ICM). The DCS is in communication with the engine and allows for human machine interface (HMI). This interface allows for diagnostics, control and data logging of the system operation of the engine and overall compressor system. It is preferable that the system is constructed comprising two distinct and connected skids, being a compressor skid and an engine skid. Hydraulic lines, electrical cable, drain and fuel gas lines connect the two skids. In the preferred embodiment of the invention, operator accessible shelters are provided for both skids.

Figure 6A:
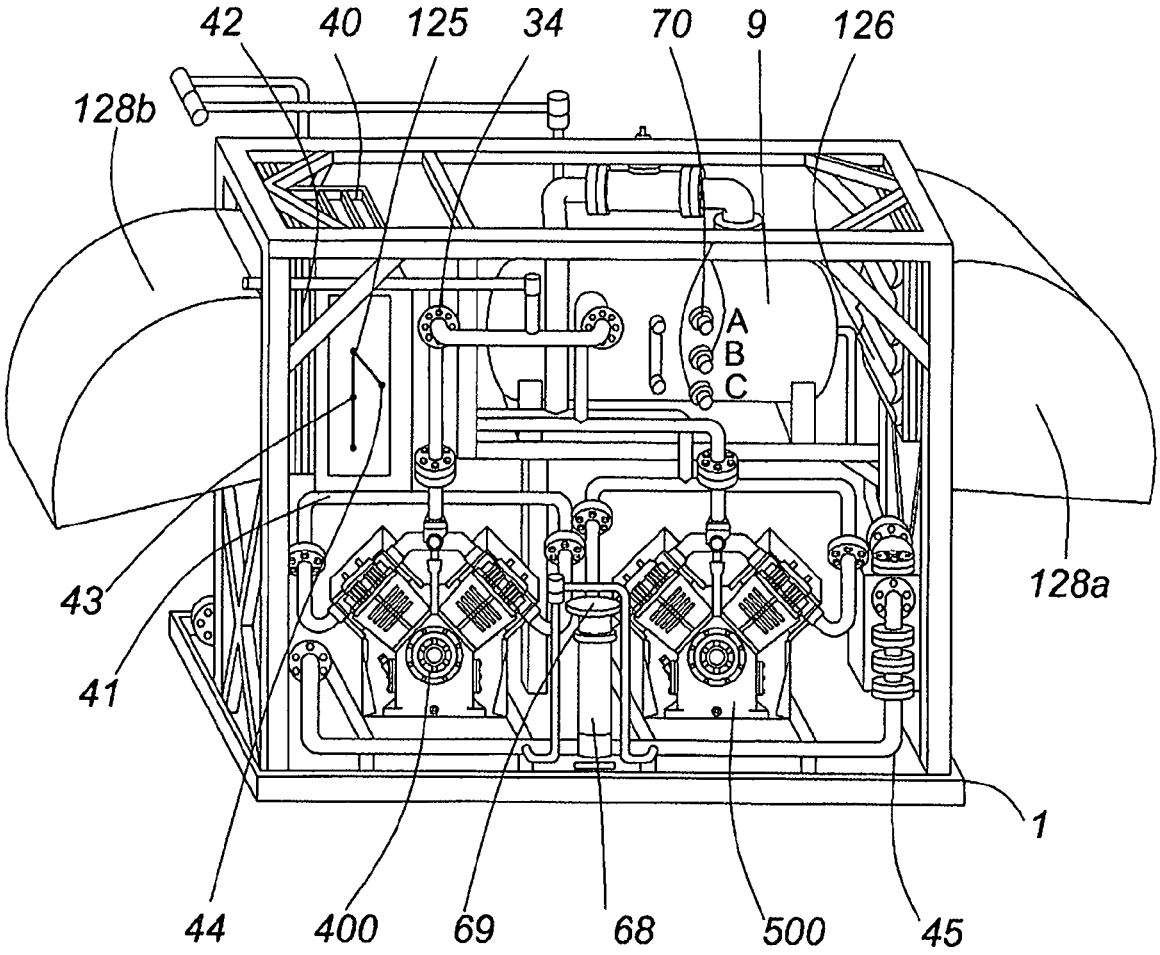
FIG. 6*a* shows a perspective view of the compressor skid.
Figure 6B:
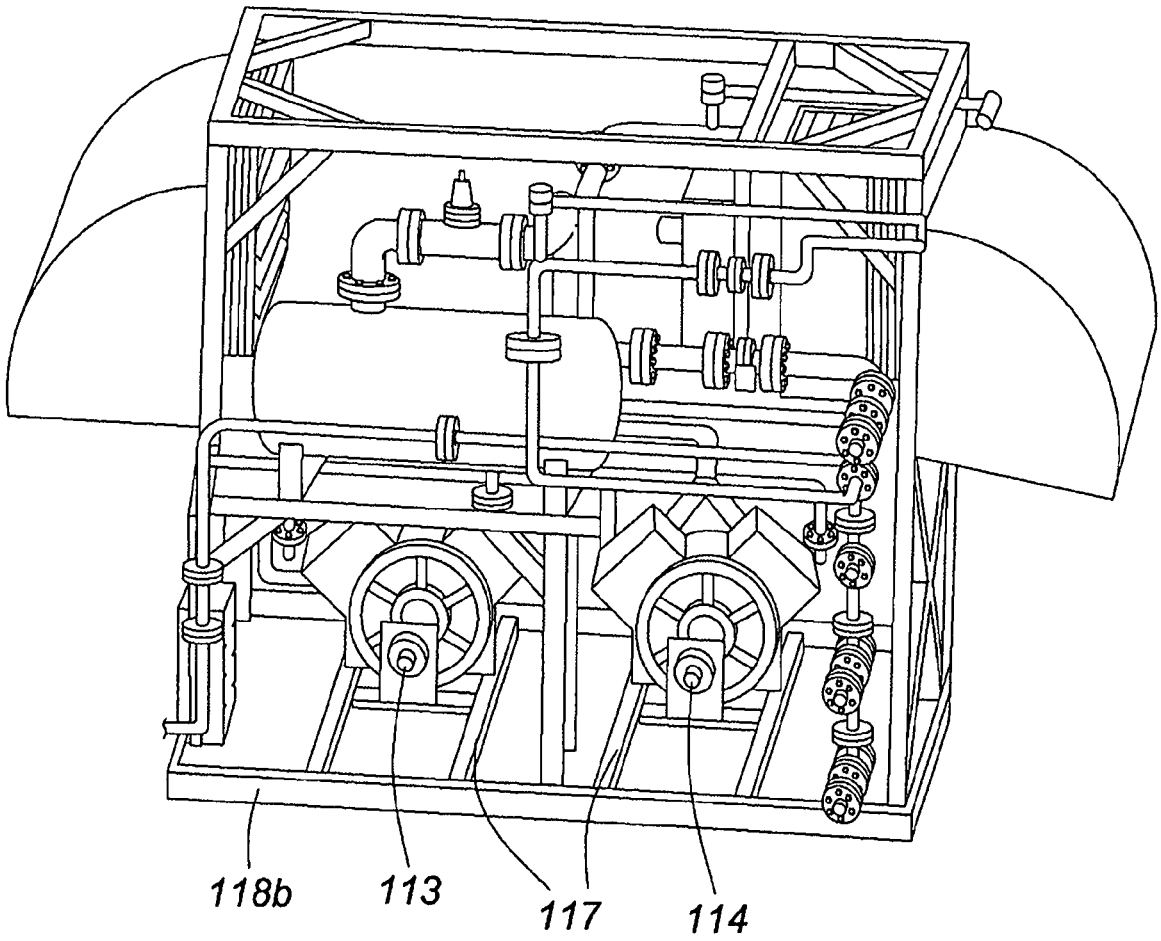
FIG. 6*b* shows details of the bottom of the compressor, opposite side.

As seen in FIG. 6*b*, the compressor skid is mounted on a sled and track assembly (117), used for moving the compressors, with rails welded to supports from the floor, and the sled is held in place with bolts, and with a shelter structure, preferably with acoustic insulation encasing the skid. The shelter includes a base where the sled and track system is located, four parallel vertical walls (not shown) and a roof structure (132).

If the compressors need to be removed the hydraulic hoses are uncoupled, bolts removed and the flanged connections on the compressors unbolted. Doors located at the back of the skid are opened and the compressors are slid out of the shelter structure. To install, the compressors are slid in along the rail until they hit the stop mechanisms, and the hydraulic hoses, bolts and the flanged connections are replaced and connected.

Figure 1:
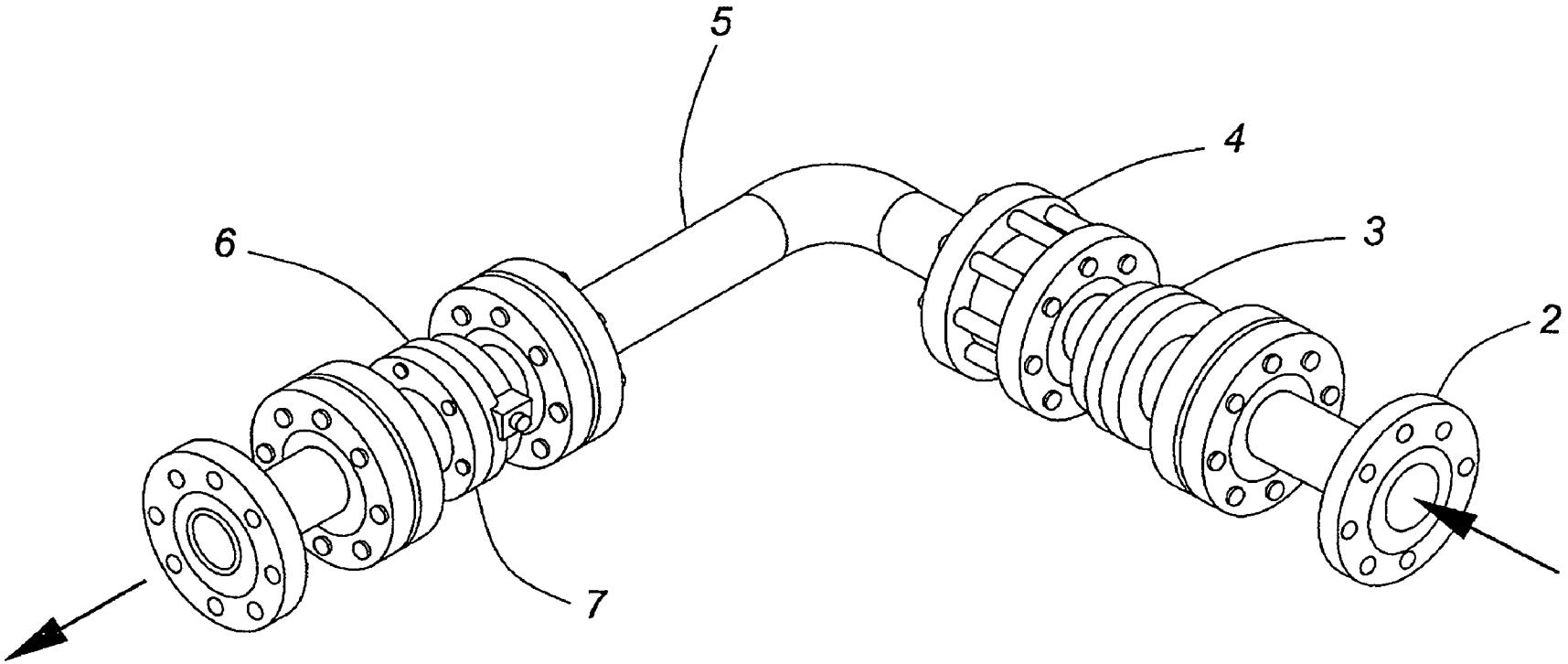
FIG. 1 shows the piping line providing natural gas flow to the pressure vessel in the compressor skid.

In the compressor skid (1) of preferred embodiment of this invention, as seen in FIG. 1, a natural gas and liquids flow is provided to the skid via a 3" 300 ansi connection (2) passing through a 3" ball valve (3). See FIG. 1. The ball valve is used to isolate the skid in the event of maintenance or if manual isolation is required. A check valve (4) is located next in the pipeline (5) which is used to prevent any reversal of flow backwards toward the source of suction. From the check valve the flow passes through a second 3" valve (6), which has an electric 120-volt actuator (7) attached to the valve stem (not shown). This actuator is used to open the second 3" valve (6) for initial start up and closes the second 3" valve (6) in the event of an emergency shut down (ESD). The electric actuator is preferably a class 1, division 1 compliant and eliminates the need for using pneumatically controlled actuators.

Once past the second 3" valve the flow proceeds into a separator (9), which is preferably a pressure vessel, see FIG. 6*a*, which is used to separate the gas and liquids in the flow. The liquids are directed to the drain (63) in the base of the pressure vessel (9) through the use of gravity and the gas is allowed to escape through the top of the separator.

Figure 2:
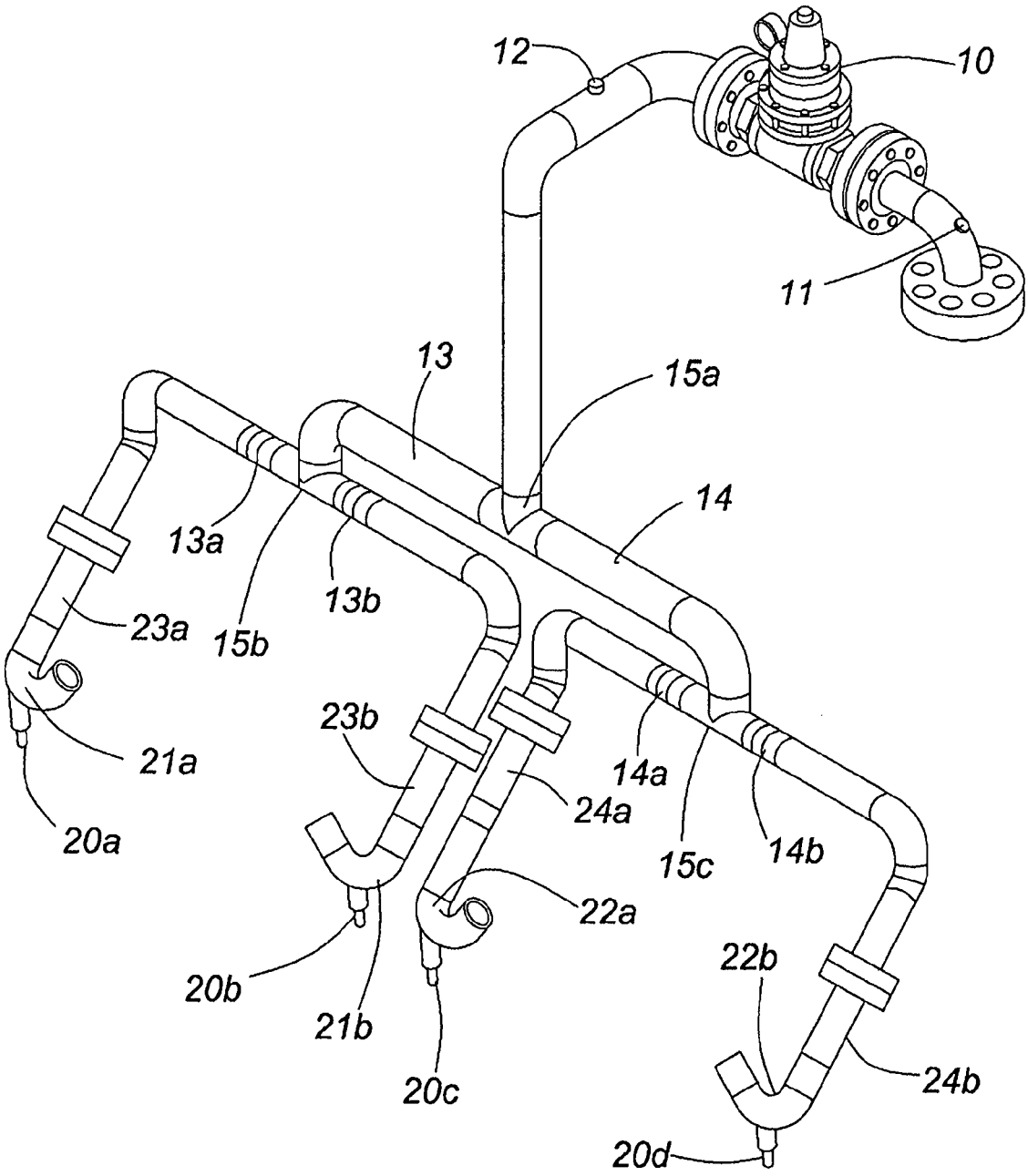
FIG. 2 shows the piping line connecting the pressure vessel to the compressors.

The gas passes from the top of the pressure vessel through a first back-pressure valve (10), as represented in FIG. 2, which is placed in the flow line to regulate the downstream pressure which must be maintained at a pressure no greater than 15 psi which is the max suction pressure allowed for this selected compressor. Two pressure sensors (11) and (12) are located upstream and downstream respectively of the first back-pressure valve (10). The sensor (11) on the upstream side sends a pressure value to the DCS which is used to determine whether the compressors need to speed up or slow down to maintain the targeted pressure. Additionally the pressure can be trended to determine performance and activate the ESD of the system in the event of a high pressure or low pressure. Also, alarm set points can be set to alert the operator to the potential of an impending shut down allowing for alternative measures to be taken.

Still flowing through the 3" piping the gas flow is directed down towards the two compressors (400) and (500) (FIG. 6*a*). As the flow reaches the bottom of the 3" line the flow is first divided into two lines (13) and (14) by a first piped T-shaped connector (15*a*) positioned directly in the middle of the pipe assembly. Each of the two lines are then divided a second time into four 2" lines (13*a* and 13*b*) and (14*a* and 14*b*) respectively by a second and third piped T-shaped connector (15*b* and 15*c*) to ensure that the flow is balanced to each side mitigating the chance of an imbalance from occurring during compression. Each of the four 2" pipes are then tied into the suction flanges (not shown) of each of the compressors (400) and (500) first stage, which has intakes (18) and (19), see FIG. 14, located on both sides of the compressors.

Also in FIG. 2, four drains (20*a*, 20*b*, 20*c* and 20*d*) are located on the elbows of the four 2" lines (13*a* and 13*b*) and (14*a* and 14*b*) just before the compressors. The drains are used to check and drain any liquids, which may accumulate in the low-lying areas (21*a* and 21*b*) and (22*a* and 22*b*) of these four 2" lines, in the event of a shut down. With the cooling of the gas flow, liquids can form on the sides of the suction piping and can potentially accumulate in these low-lying areas. If the system is started without draining the liquids potential damage could be caused to the compressors.

Additionally, stainless steel suction braided hoses (23*a* and 23*b*) and (24*a* and 24*b*) are installed in the two 2" suction lines to ensure that no strain or load is passed onto the compressors. The hoses can also accommodate slight degrees of misalignment, which could happen during installation or materials expansions and contractions during operation. All connections are flanged to allow for ease of removal and installation.

Figure 3:
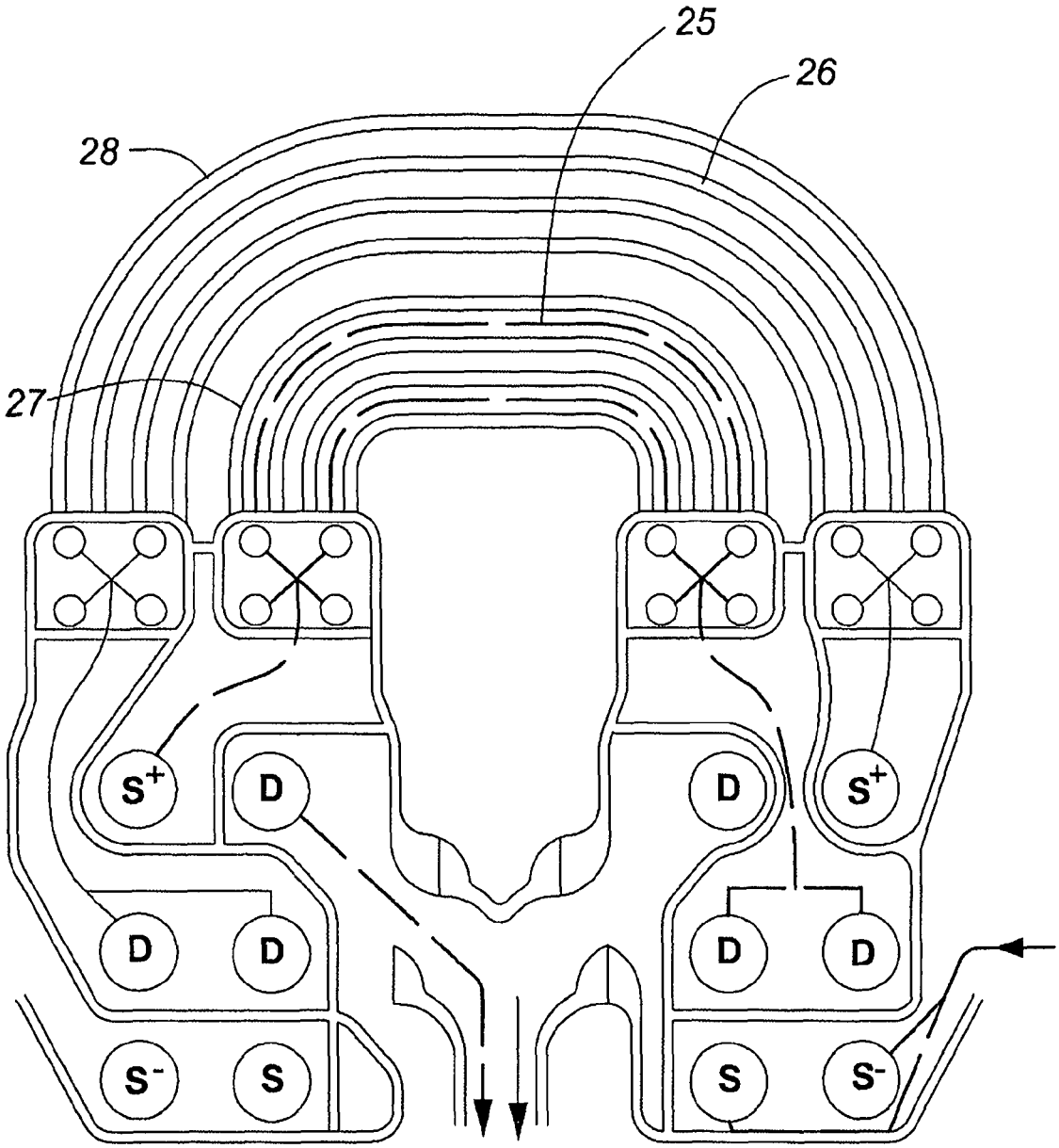
FIG. 3 shows the inter-coolers including the finned tubes.
Figure 4:
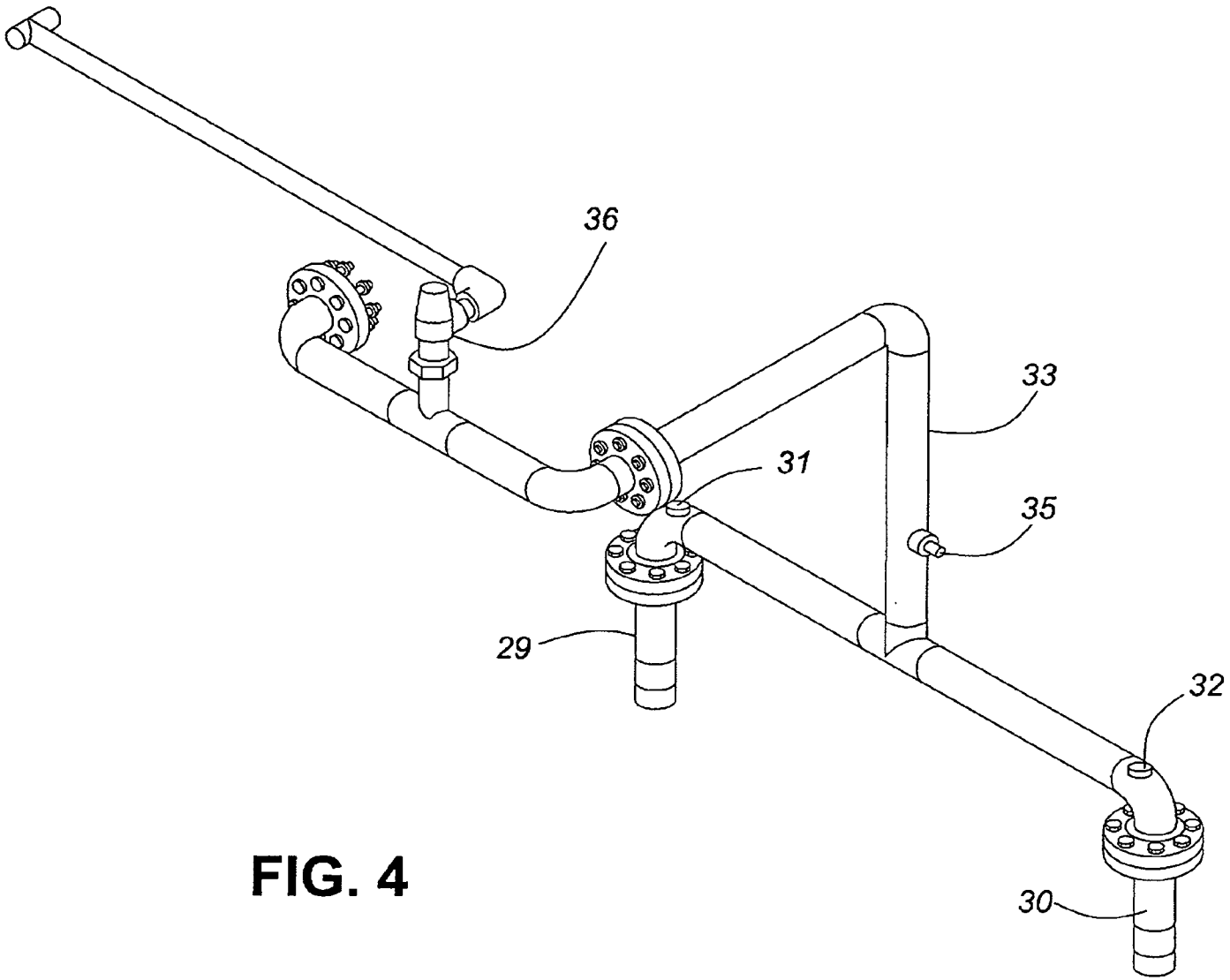
FIG. 4 shows the piping line connecting the compressors to the after-coolers.
Figure 5A:
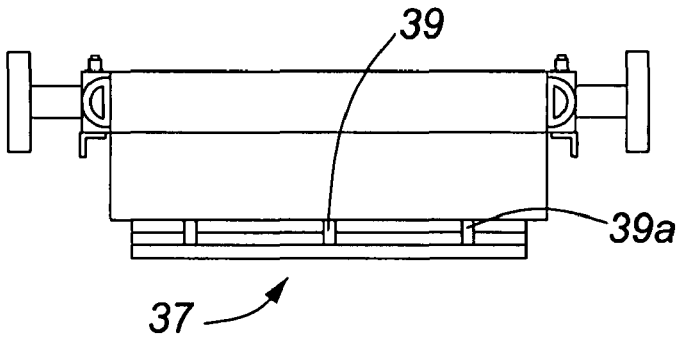
FIGS. 5*a*, 5*b*, 5*c* and 5*d* show the cooler fan with the hydraulic motor.
Figure 5B:
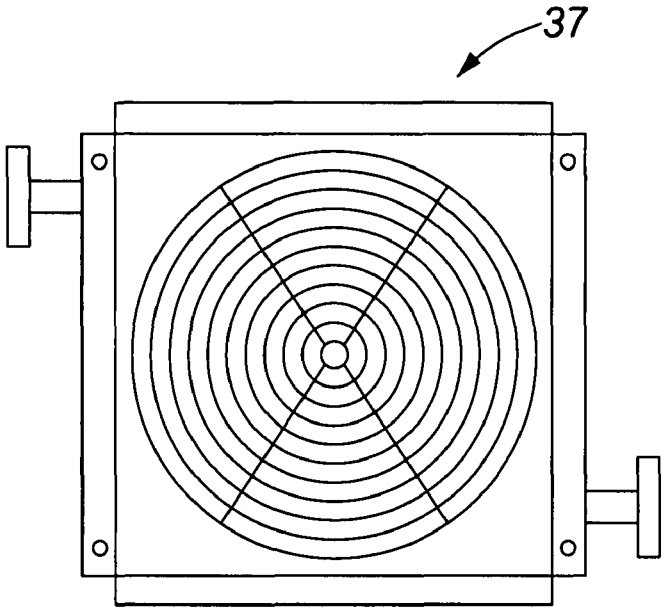
Figure 5C:
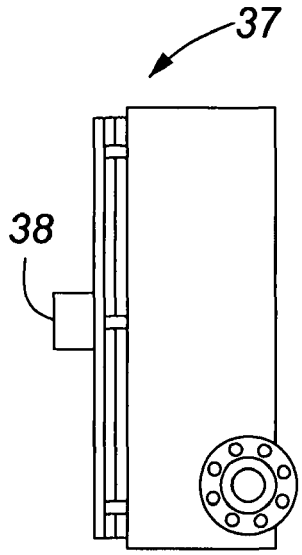
Figure 5D:
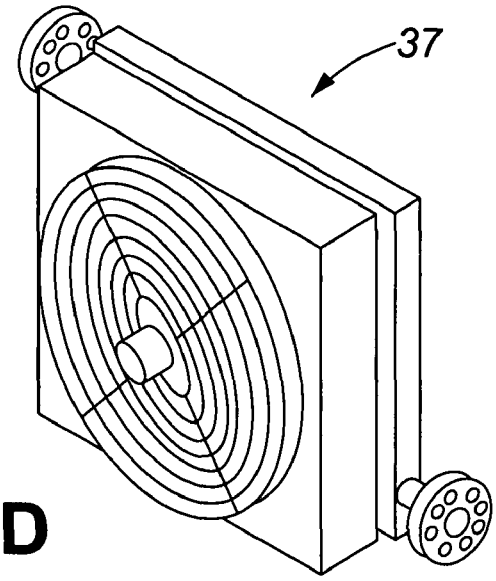

The gas flows are then compressed from the first stage to the second stage of the compressors through inter-coolers (25) and (26) which are part of the compressors and each including finned tubes (27) and (28), as shown schematically in FIG. 3. From the second stage the gas flows leave the compressor by discharge flanges (124*a* and 124*b*), see FIG. 14, expelled through stainless steel expelling hoses (29) and (30) which are used for the same reason as the suction hoses. The gas flows are passed by first and second temperature sensors (31) and (32) for monitoring the discharge gas flow temperature, see FIG. 4. The temperature can be used to alert the operator of faulty valves or other anomalies associated with the compression process. Again the sensors communicate to the DCS which can provide graphing details, high temperature alarms, and shut downs.

Both gas flows, heated from the compression process, coming from the two compressors are then combined back into one common fifth 2" pipe (33) which leads the combined gas flow to an after-cooler (34) see FIG. 6. The combined gas flow will first pass by a third pressure sensor (35) which again communicates to the DCS and provides protection from over pressuring the system in the event of some form of blockage happening down stream of the compressors. Additionally, there is a pressure safety valve (PSV) (36) located on the common 2" pipe (33) between the after-cooler and compressors and is set to relieve at the systems maximum design pressure of 300psi. The after-cooler dissipates the generated heat, by cooling the gas flow from the compressors, to atmosphere by way of an air forced flow through the cooler.

As it can be seen from FIGS. 5*a*, 5*b*, 5*c* and 5*d*, a cooler fan (37) is powered by a hydraulic motor (38) attached to the fan shaft (39) by way of a coupler (39*a*). The after-cooler is designed to minimize the effects of sound pollution which is generated from moving high volumes of air. Two recycle louvers (40) and (41) are located on the top and bottom of the ducting (125), see FIG. 6, and an outlet louver (42) on the outlet of the ducting (125). These louvers are linked together by a linkage (43), which is connected to an electric actuator (44), which is controlled from the DCS. In the event that the room temperature falls, the electric actuator is sent a signal to open the two recycle louvers and as a result the outlet louver begins to close as the recycle and outlet louvers are interconnected by the linkage. This system is designed to maintain a set temperature as input by the field operator and is monitored via a fourth temperature sensor (45) located on the base of the adjacent wall at the opposite side of the ducting.

The shelter structure of the compressor skid includes louvers (126), located on the wall at the opposite side of the ducting, which draws fresh cool air into the shelter. All of the louvers are designed with lightweight materials, and can be closed to preserve heat in the building in the event of a system shut down. The intake louvers will also close if the system goes into recycle again, assisting this way in maintaining heat in the building. It is preferable that hoods (128*a* and 128*b*) are attached on the outside of all intake and exhaust ducts which are lined with acoustic insulation to dampen the sound waves generated from air movement, in addition to stopping the intake of debris and weather from outside of the building. The intake is fitted with a deflector plate (not shown) which forces the air to the roof structure ensuring that there is no separate temperature zones, and also ensuring thorough mixing of cold and warm air, minimizing the chance of freezing occurring directly below all intakes.

Figure 7:
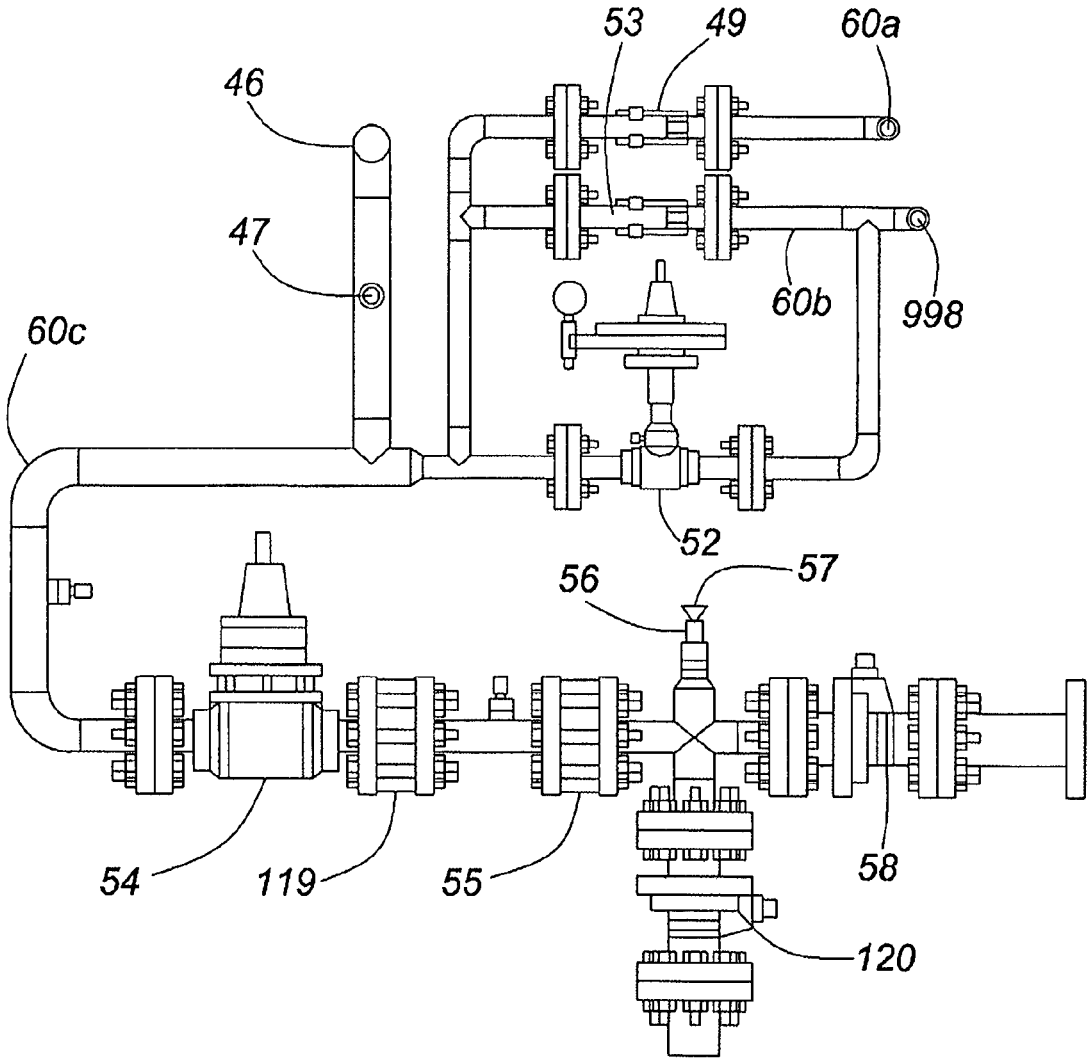
FIG. 7 shows the first portion of the piping line connecting the after-coolers to the engine, to the water valve, and to the line exiting the compressor skid to the end users connection.

In FIG. 7 the cooled gas flow then passes from the after-cooler to a discharge pipe (46) located downstream. A fifth temperature sensor (47) is positioned in the downstream pipe and communicates the temperature to the DCS which can use this information to speed up or slow down the cooler fan based on the desired set point. Trending, alarms and shutdown functions can also be generated from the temperatures indicated. The system must ensure that hot gas flow does not enter any external pipeline as the gas is heated when it is compressed, and external pipelines may not be able to withstand the high temperatures and severe damage can occur to the plastic outer cover of the pipelines, which would result in a place for corrosion to begin.

Figure 8:
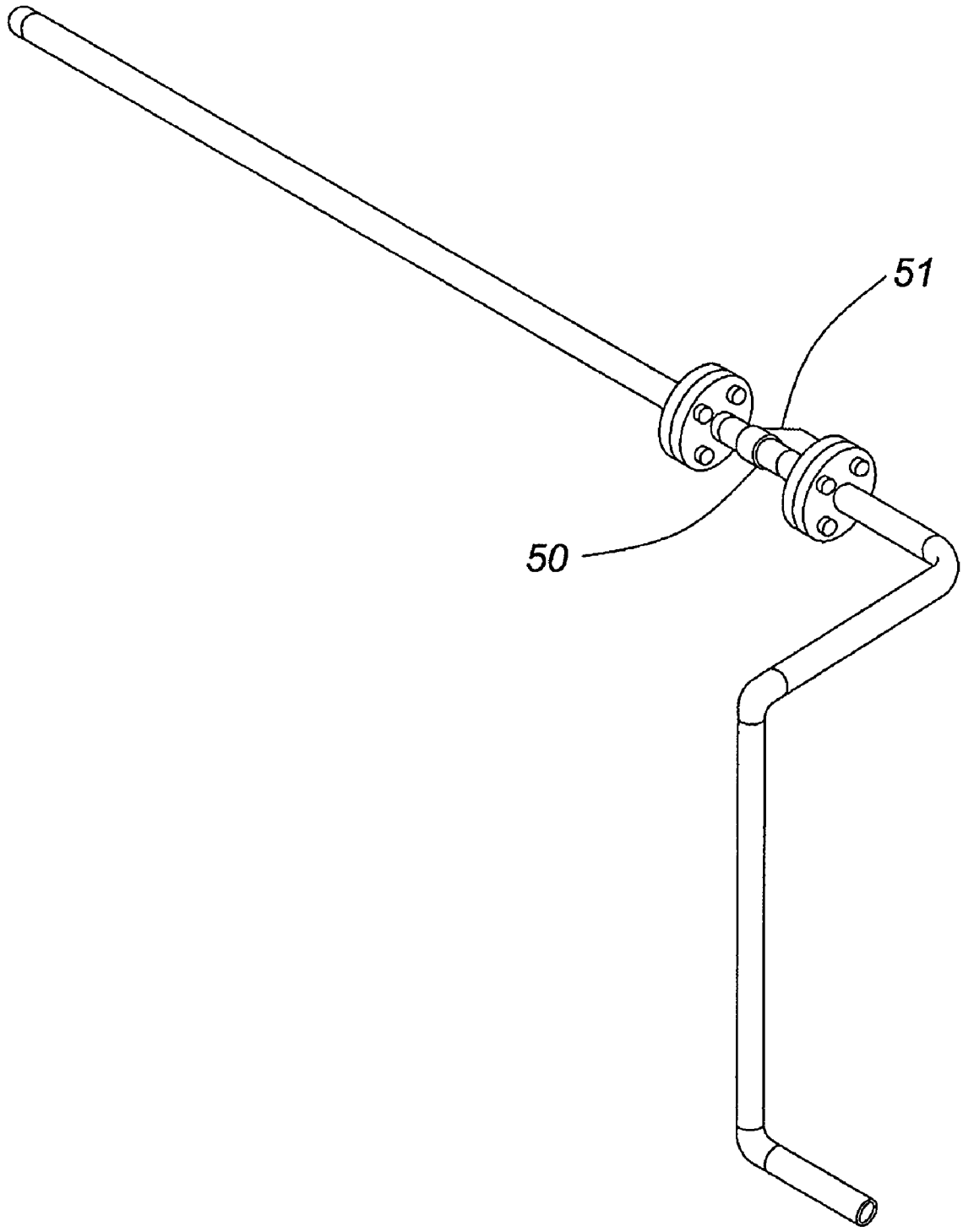
FIG. 8 shows the fifth piping line, including the ball valve and the electric actuator, connecting the after-cooler to the engine.

The cooled gas flow is then led from discharge pipe (46) to three different directions. A first flow is directed through a gas fuel line (60) in which fuel gas flows. The fuel gas flow is piped then to the engine skid to power the engine (300). The fuel line is equipped with a first manual valve (49) for starting and stopping the flow of gas at the operator's discretion. In FIG. 8, downstream from the manual valve a second ball valve (50) is located with an electric actuator (51), which is used to open the fuel supply during start up and close the fuel supply in the event of an ESD situation. This is a safeguard to protect the engine compartment from any further fuel being allowed to flow into the skid.

A second flow is directed to a second back-pressure valve (52), which is used to maintain suction pressure for the compressor at a desired preset pressure, and then directed to the end user connection. In the event the compressor suction begins to fall into a low suction situation the second back-pressure valve will open based on pressure imbalance and allows high pressure gas to flow back to the pressure vessel (9) ensuring the system will not shut down. This is necessary, as most gas wells will not produce at consistent rates, which result in surges going from next to no flow to huge influxes of pressure. The second back-pressure valve is fitted with a bypass line (53) to allow for a path to depressurize and purge the system. This eliminates the need for the back-pressure valve to be adjusted resulting in more reliable service.

Figure 14A:
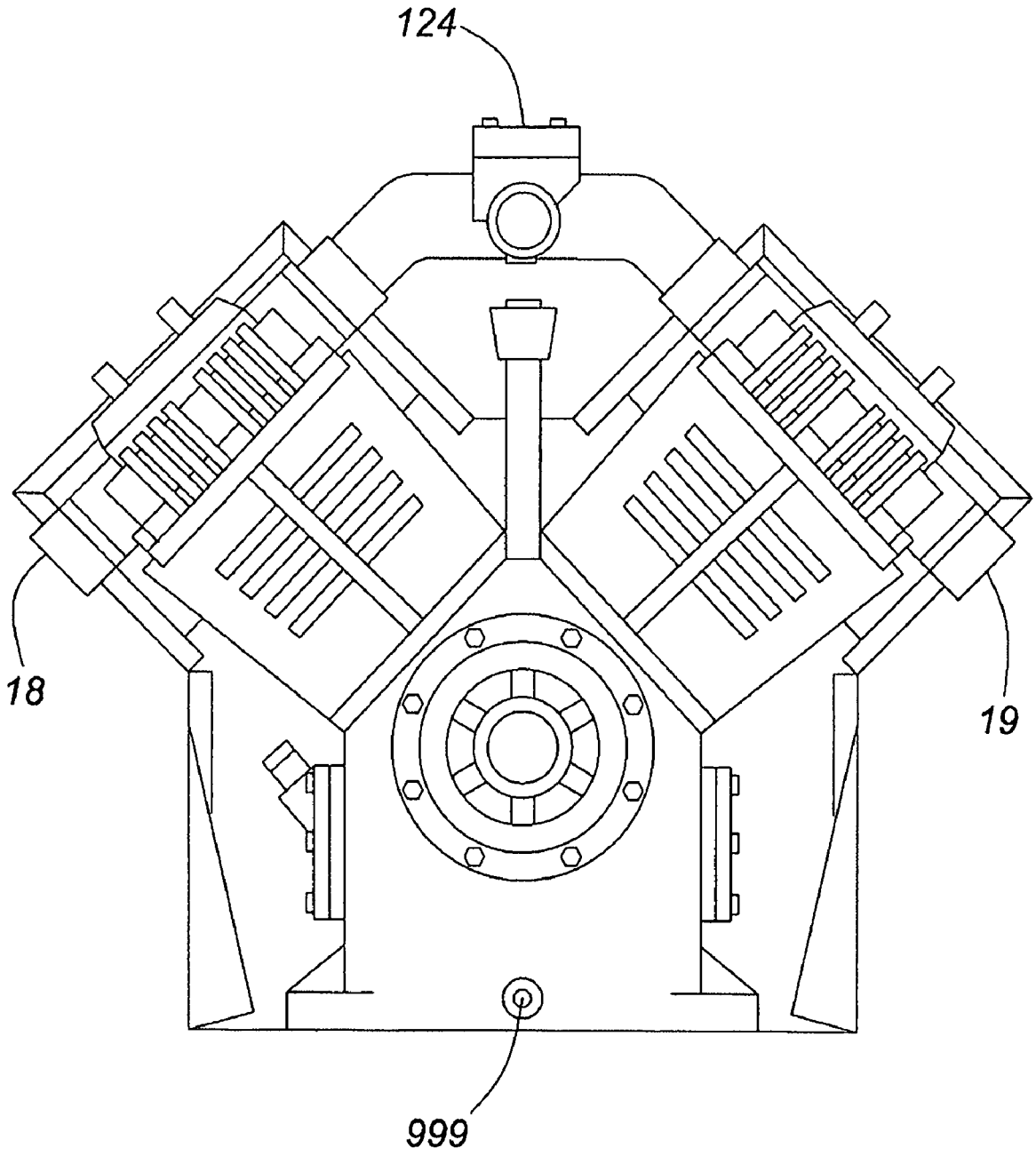
FIGS. 14*a* and 14*b* show a front and side view of the compressor, respectively.
Figure 14B:
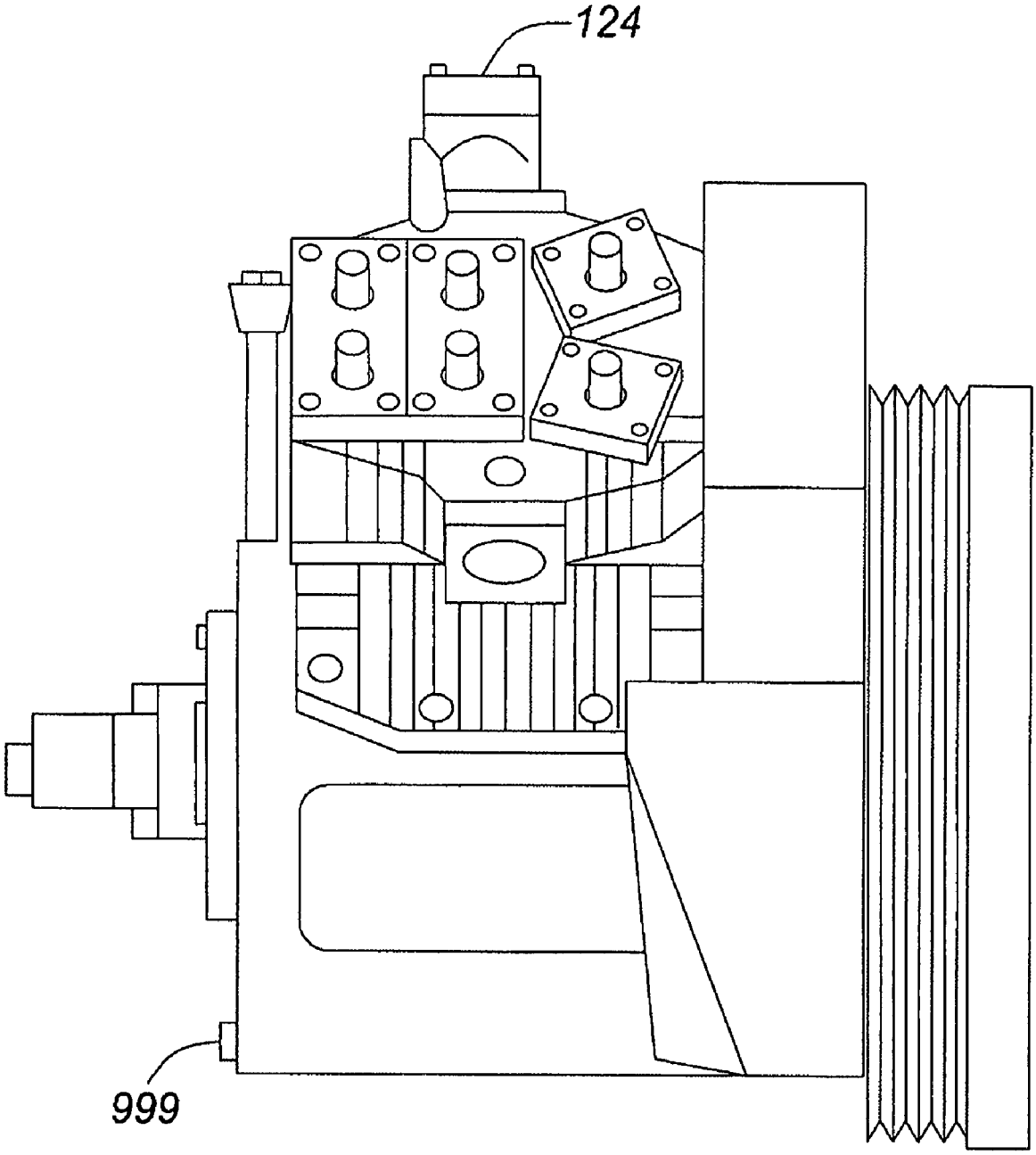

Also in FIG. 7, a third flow passes through a discharge back-pressure valve (54) which is used to maintain a minimum pressure helping prevent the liquids from condensing during the compression process and causing contamination to the lube oil in the crank case (999), see FIG. 14, on the compressors. Additionally the pulsation caused from any reciprocating movement from the compressors is dampened, resulting in a smoother flow rate for metering down the line. Again a bypass (not shown) is provided around the discharge back-pressure valve (54) to allow for purging. Once past the back-pressure valve the gas flow passes through a gas meter (119), used to meter the volume of gas produced, and a second check valve (55) which prevents any reversal in flow from coming back into the compressor, this includes liquids which will be present on the downstream flow. Beyond the check valve a small buy-back line (56) is piped back to the pressure vessel (9) with a manual ball valve (57) which is put in place to allow for the operator to open and close as required. This buy-back line is used to provide fuel pressure for initial start up by allowing a path for the pipeline pressure to flow back into the system in the event that the wellhead pressure cannot support the fuel requirements of the engine. Once compression is established this line under normal circumstances would be closed. The gas then passes through a second ball valve (58) located on the discharge line as it leaves the compressor skid and is directed to the end user connection. This valve provides the operator a means of isolating the compressor skid for maintenance or any other reason that may require the isolation to take place. A water valve (120) is used to direct produced water flow, to gas line or any other location.

Figure 9:
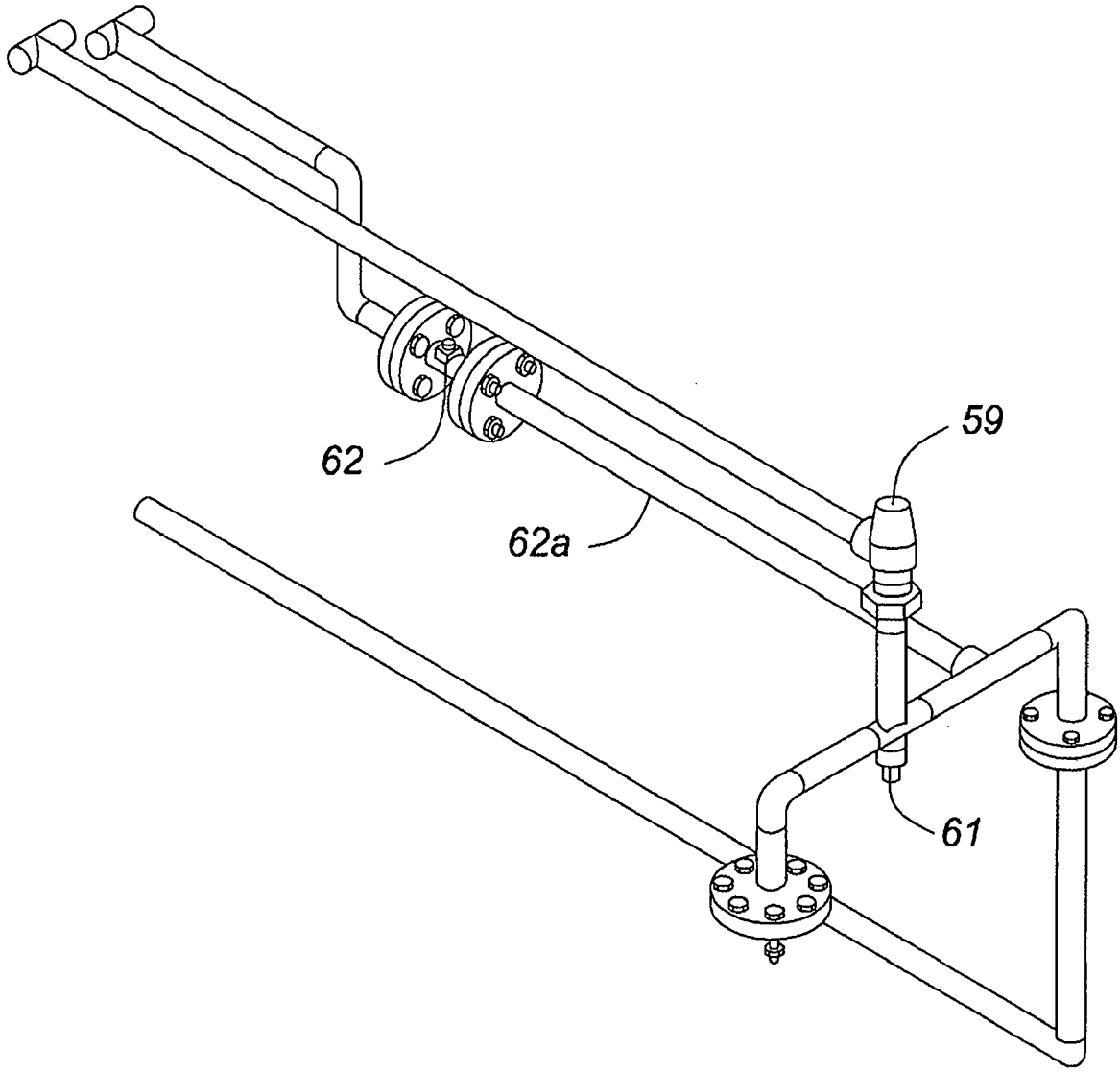
FIG. 9 shows the compressor relief piping line.

In the event that the system maximum operating pressure of 300 psi is exceeded a pressure safety valve (PSV) (59) will relief (see FIG. 9) and the gas is expelled from the compressor skid. Then the recycle line (998), see FIG. 7, coming from back-pressure 52, ties back in just below the PSV to allow a gas flow path back into the pressure vessel. Additionally a drain line coming from the fuel scrubber in the engine skid is piped to a connection (61) just below the PSV, which allows for the fuel piping system to be drained using a second manual valve located on the fuel scrubber (not shown). Also the buy back line (56) flows through connection (61). Depressurization of the compressor skid can be accomplished through the flare line (62*a*) using a third manual valve (62); this operation can only be preformed by the actions of an operator.

Figure 10:
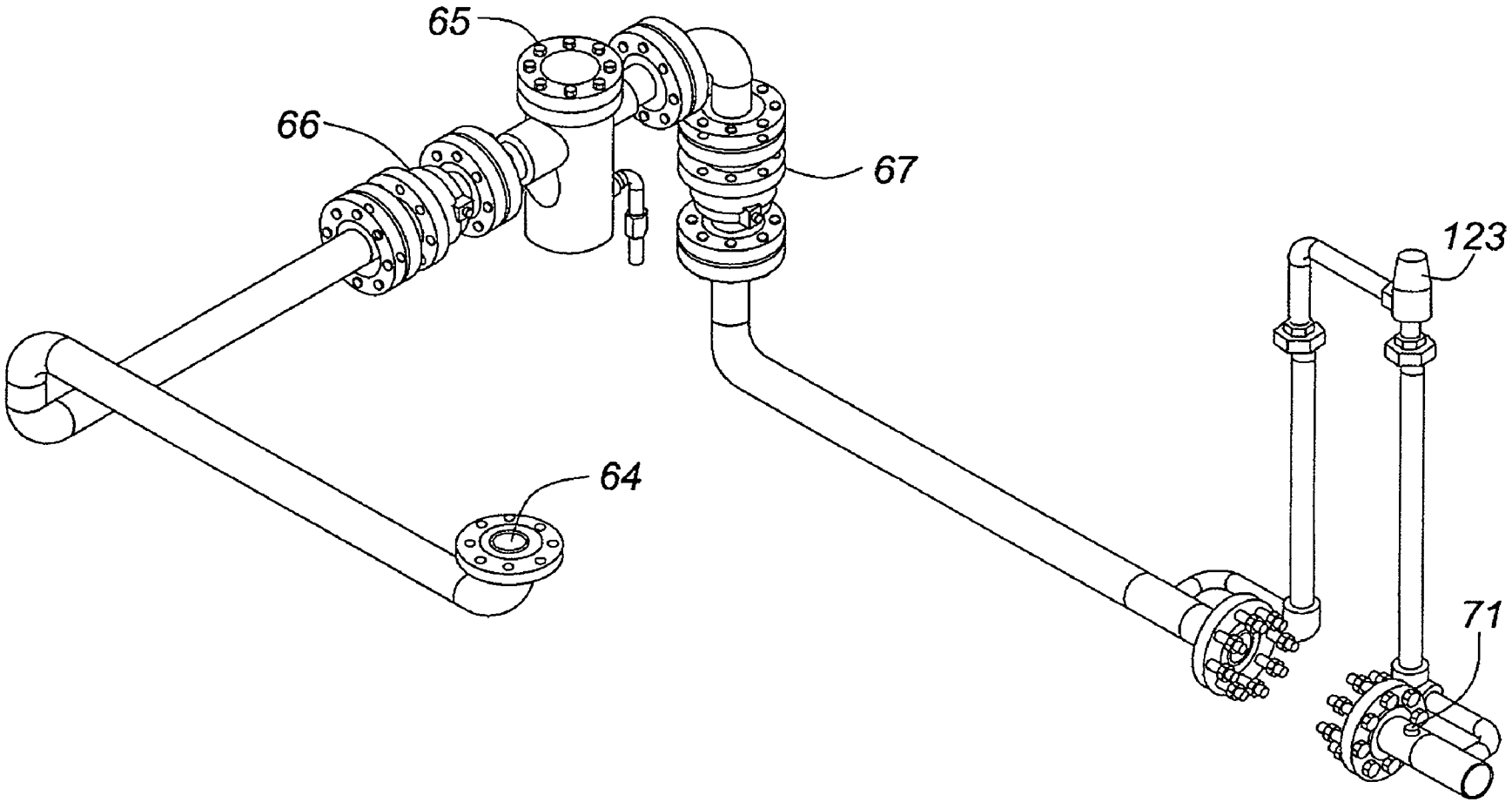
FIG. 10 shows the pressure vessel draining line in connection with the pressure safety valve for the water pump.
Figure 11:
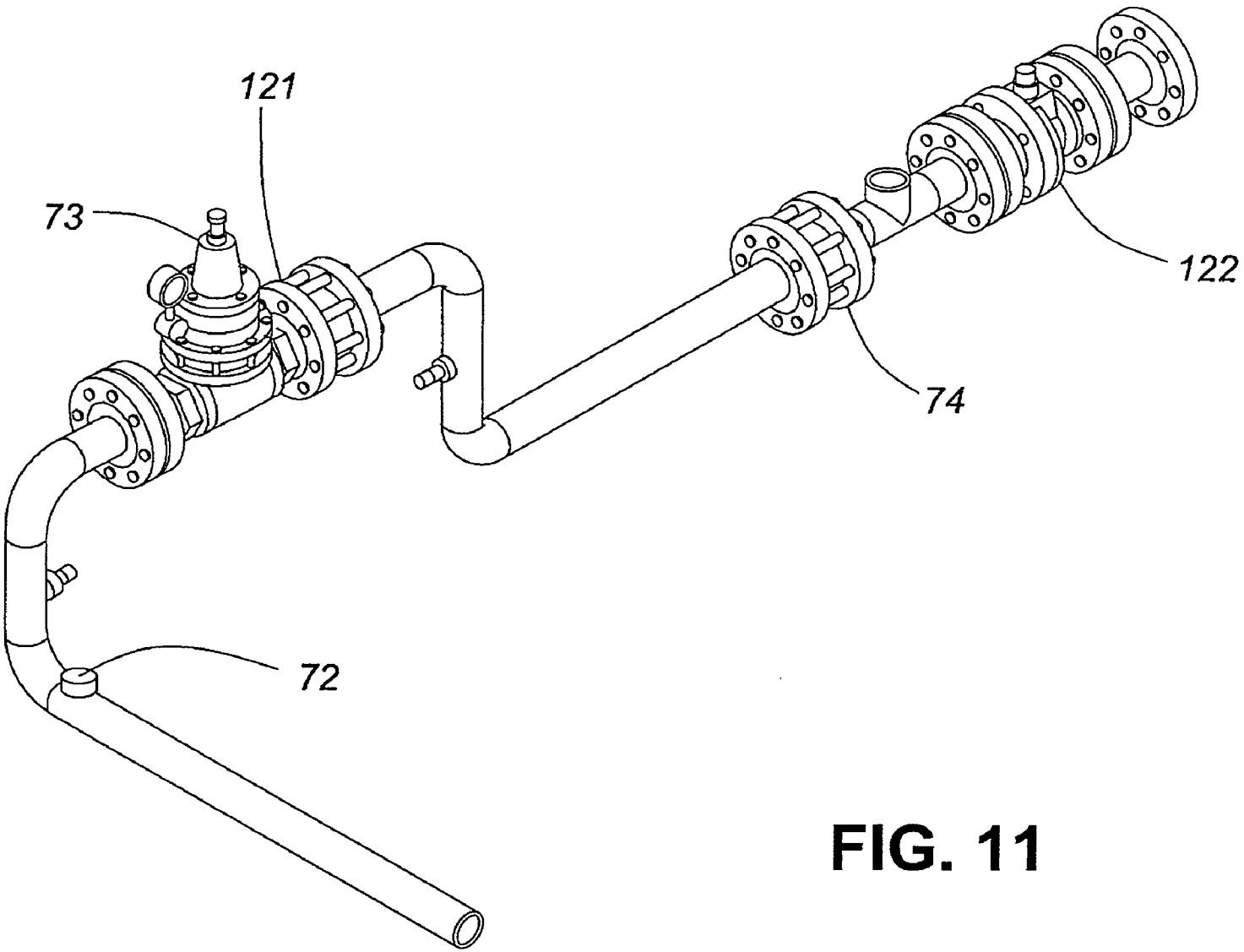
FIG. 11 shows the liquid discharged line for the water from the pump.

Any liquids collected on the drain (63) on the bottom of the pressure vessel are drained from the bottom through a fourth 2" pipe (64), see FIG. 10, leading to a basket strainer (65). The strainer has an upstream valve (66) and a downstream valve (67) to allow for the basket to be removed and cleaned. The strainer is used to keep any foreign material from passing to the water pump (68), see FIG. 6*a*, as this can cause plugging and eventual failure of the pump. The pump is a multi stage centrifugal pump with a vertical orientation and is driven by a hydraulic motor (69) attached to the top of the water pump. The pump is started and stopped from the level switches (70) which are located on the side of the (pressure vessel (9). A pressure safety valve-PSV (123) for the water pump is provided, see FIG. 10. The middle-level switch (70*b*) is the initiating action for starting the pump, the lowest-level switch (70*c*) is used to turn the pump off. The highest-level switch (70*a*) is used for initiating an ESD of the system in the event of a high level situation. This can occur if the pump fails to start or the volume of water coming into the pressure vessel (9) is too great. The liquid is discharged from the pump and is monitored by a fourth pressure sensor (71) located downstream. This sensor performs the same function as all other similar sensing points in the system. In the event the maximum discharge pressure is exceeded the PSV located down stream relief's the pressure to the suction side of the pump ensuring the system safety. In FIG. 11 it is seen that also located downstream is a low flow switch (72), which is used to shut down the water pump hydraulic motor in the event that the fluids flow is stopped. An example of this type of situation could occur due to a plugged off suction strainer or an inadvertently closed suction valve.

The liquid then passes through a third back-pressure valve (73), which is used to maintain a minimum discharge pressure. This is done to help maintain the water pump in the desired pump curve. If the pump operates outside of the pump curve damage can occur to the pump. A water meter (121) is used to meter the volume of liquids produced and passed through the pump. Again a bypass (not shown) around the kimray is used to allow for purging during system start up. As the liquid proceeds beyond the third kimray valve it must pass through a third check valve (74) to prevent flow reversal and through an isolation valve (122) on water line, allowing the operator to manually isolate the discharge line.

Liquid flow paths can be selected by the operator once the flows go beyond the third check valve (74) and isolation valve (122) and also once the flow goes beyond the water valve (120). The liquids can be sent on an independent line, which can be attached to an injection well (not shown), a tank (not shown) or any other equipment as desired by the operator. The second choice is to combine the liquid back into the gas stream as it is discharged from the skid.

A first lip (118*b*) is placed around the skid to contain any leaks, which may happen.

The present invention has additional features, characteristics and advantages in relation to the prior art, some of them we describe below:

- All valves, check valves, kimrays and any part which is mechanical by nature and may need to be removed may have a flanged connection. This allows for removal of the specific component without having to dismantle the piping system.
- Almost all the piping may be welded in the skid to ensure that leaks will not develop, which happens with threaded connections.
- The louvers are designed for automated control of the ambient temperature inside the shelters. They will adjust to the variations in temperature that may occur in the ambient temperature.
- Perimeter access can be provided to the building to ensure that the unit parts of the skid can be worked on and operated.
- A catch all or lip could be put around the entire skid to ensure that contaminants are contained inside the skid.

The hydraulic lines could be attached through a plate which is recessed into the wall of the shelter structure of the skid to ensure that no connections are protruding beyond the wall. This will ensure they are not damaged during transport.

All hydraulic connections are unique to ensure that the unit cannot be hooked up improperly.

Sensors provide not only shut downs, but also provide the operator a tool from which they can diagnose, optimize, evaluate and create reports from. This creates a window into the operation of the unit for the operations staff. Also the system becomes more robust in the way in which it can be used.

All electrical components can be connected with explosion proof cannon plugs. This will make it possible for electrical parts to be changed out by anyone, and eliminates the need for expensive electricians to come to site and perform the work. Also the devices can be supplied preset which means they just have to be plugged in with no adjustment.

The sight glass on the pressure vessel uses the high-pressure discharge gas to blow the glass clear back into the vessel which eliminates the need to drain to atmosphere. This is just one more way to eliminate the venting to the atmosphere.

The hydraulics employed in this system allow for multiple functions to be undertaken at one time. This allows for a uniquely designed process which can accommodate a multitude of operational conditions.

All hydraulic motors are made to be removed with the use of wrenches and no more than four bolts.

Structurally the skids and frames have been engineered and endorsed to ensure that a minimum safety standard was used. The compressor and engine skids have a safety factor of 5 times rated weight.

A protective cover around the engine, of a new design using stainless steel plate fastened to a frame using pins and clips, can be used. This allows for the removal of the covering without the need of tools.

This invention seeks to provide a sophisticated process and control system, and assembled it in such a way that someone with little to no training can operate and maintain it. This should prove value added to the end customer as they will not require as much training time or level of skill to run and maintain the unit.

FIG. 12 shows the engine skid, which is a separate standalone skid and is used to power the compressor package through the use of hydraulics. The reason for preferably using a separate skid is the fact that the use of hydraulics allows the engine to be located remotely from the gas compressor. This allows maintaining the required spacing needed to declassify the engine compartment avoiding the necessity of having everything built to explosion proof standards, if necessary. Alternatively, the operator can be placed at a safer distance from the actual compression process which may be happening in another building.

Figure 12A:
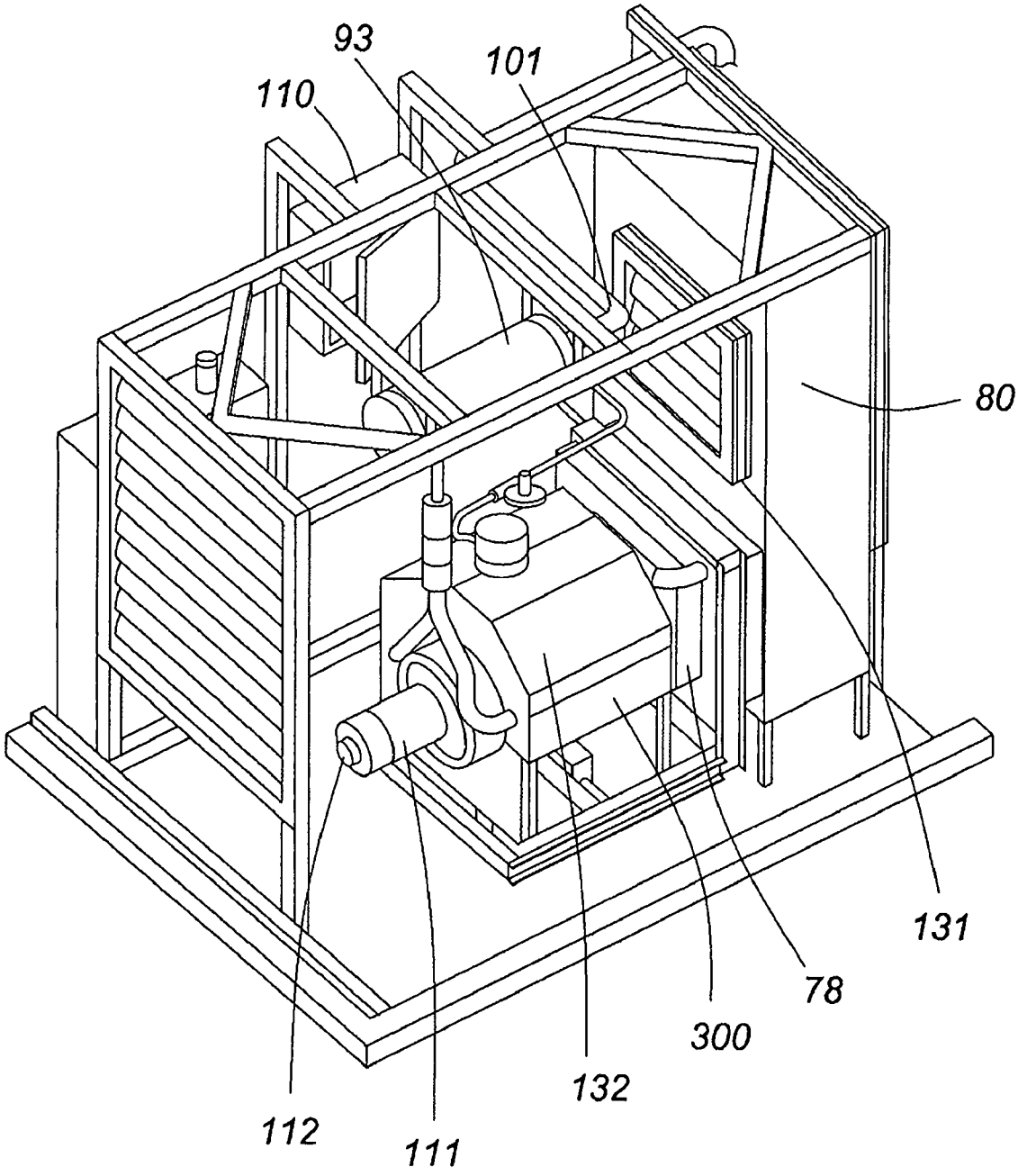
FIGS. 12*a* and 12*b* show perspective views of the engine skid.
Figure 12B:
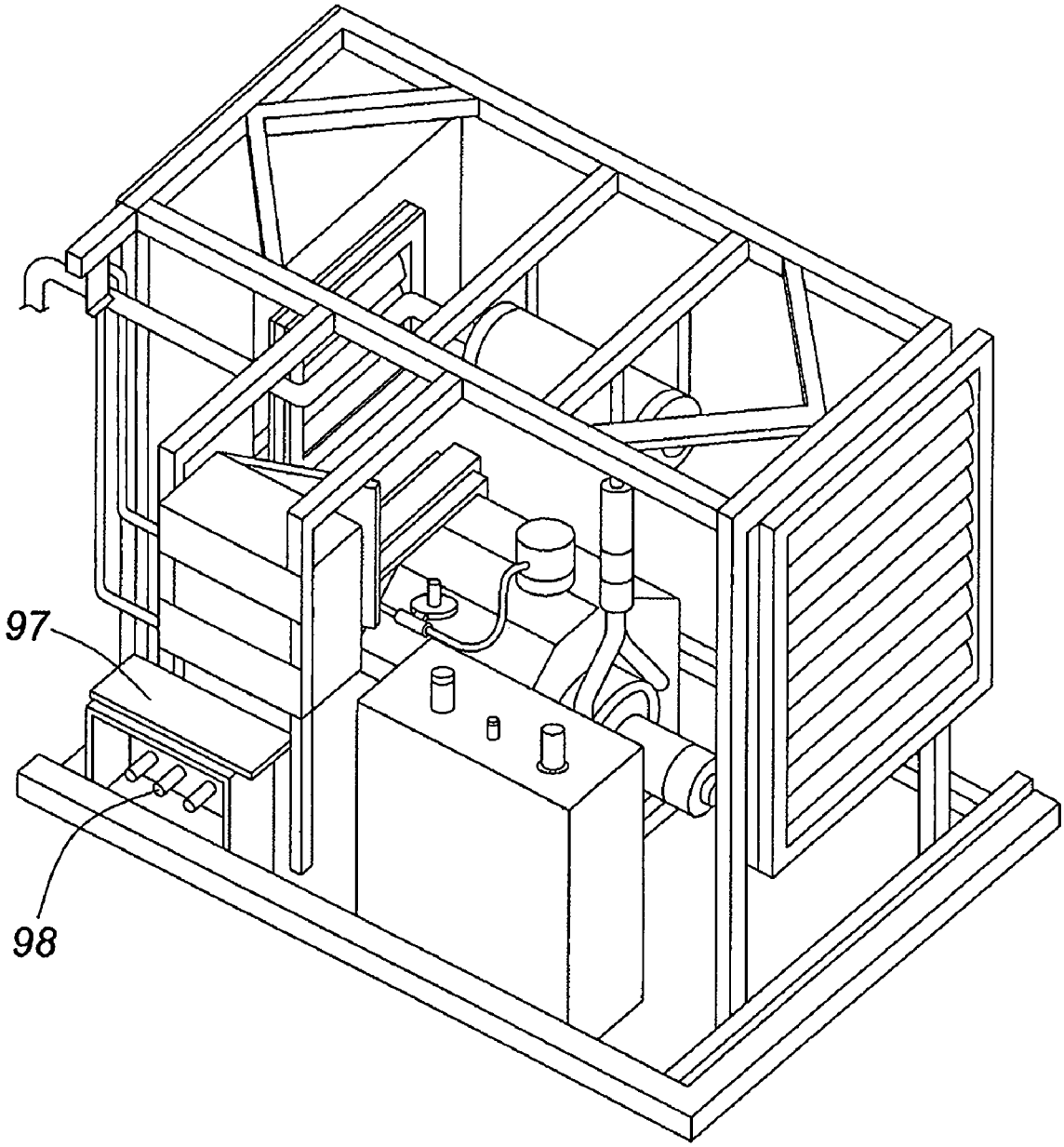

In FIGS. 12*a* and 12b it is shown that the engine skid includes an engine (300) a shelter structure (132) and a power source (not shown), which could be an electric motor or anything that will provide energy to drive the hydraulic motor and the distributed control system DCS (110). It is best that the power source is a fuel engine. The engine (300) has a radiator (78) and is used as the driver and is preferably powered by natural gas. The engine (300) runs a computer readable software, which controls speed, shut downs and provides information as to why the unit is running poorly or has shut down. The engine is mounted to allow for quick and easy removal from the shelter structure.

The computer readable software controls the motor and enables setting parameters to control the engine performance and view the reason for shut downs occurring. Examples of this would be controlling the horsepower available for the compressor.

With the present invention it is possible to use the program to produce the actual horsepower needed and set the maximum hp that the unit can run at. One of the advantages of this invention is the fact that it can be set to run at a higher or lower hp based on the customers needs. The engine skid is also able to adjust itself through the use of an altronic governor (not shown) to meet any variation in the load placed on the unit. It is preferable to place a protective cover (132) around the unit to ensure the operators do not accidentally come in contact with the engine (300)

An insulated covering is provided for the exhaust system (79) to ensure no possibility of burns occurring during operation.

Multiple ducts (80) are attached to the radiator and the ducts coming off the radiator is used to direct the air up and out of the skids enclosure. The ducting is designed to provide sound dampening which will make the engine skid very quiet in operation. This will enable it to meet regulatory rules put in place by the governing bodies in different locations. These ducts are also equipped with an internal louver each (131). This louver is opened to direct the air into the skid to maintain adequate temperature in the cold winter months.

The DCS (110) is located in the engine skid and provides a way by which all the information gathered from the different sensors, meters and devices could be managed. This is also the point from which the operator can control the entire system locally or from a remote site if a wireless link is desired.

Figure 13:
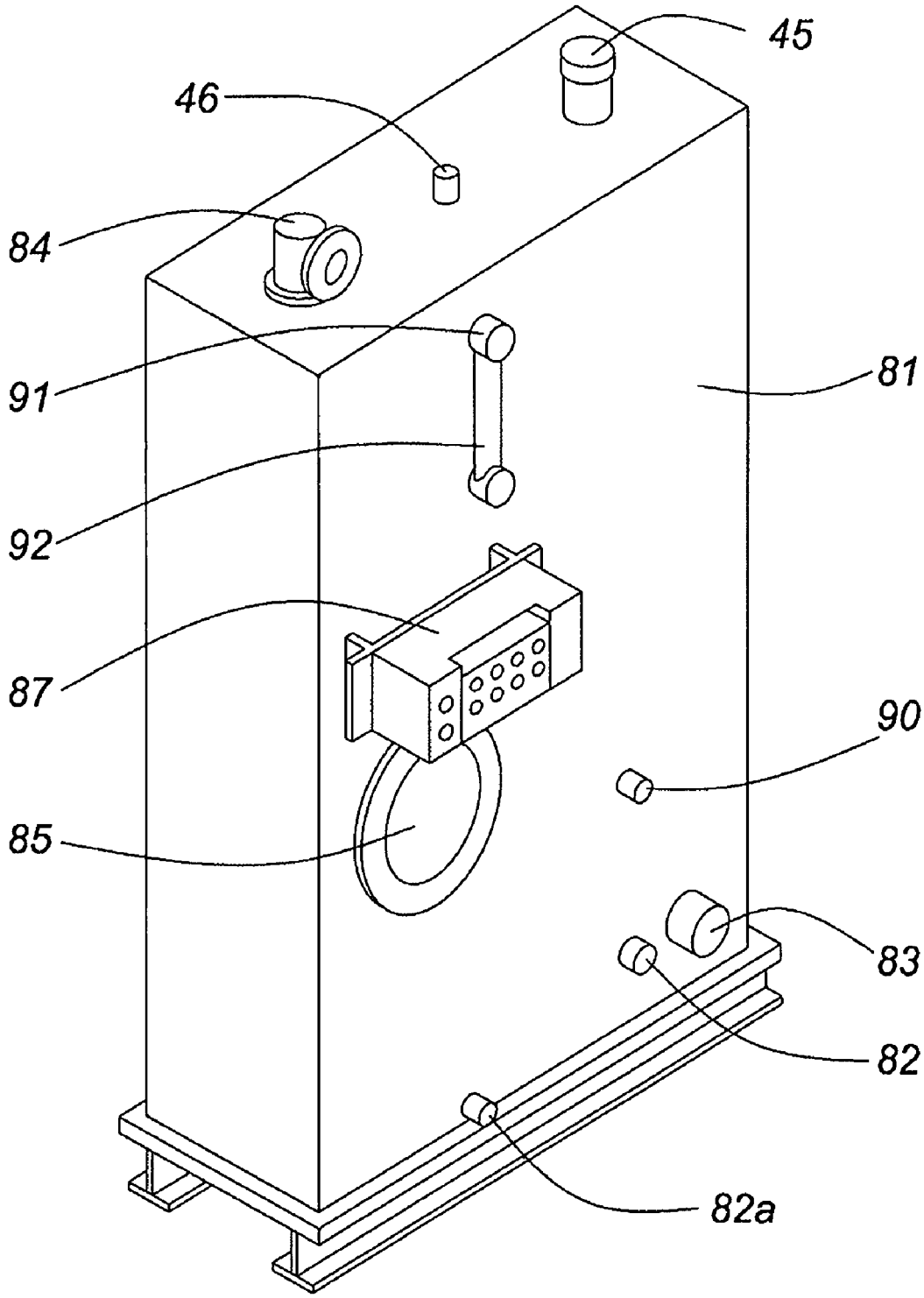
FIG. 13 shows the hydraulic tank of the engine skid.

A hydraulic tank (81), as seen in FIG. 13, is also located inside the engine skid and provides the supply of oil to the system and has a weir (not shown) in the tank to minimize agitation and hold any solids, which accumulate away from the suction. The hydraulic tank has supply lines (82) and (83), a return line (84), a fill spout, for adding hydraulic oil (115) and a case drain (116), where the oil is returned from the hydraulic motors if the seals leak.

Mounted on the tank is a valve assembly (87) which is used to direct the hydraulic flow to all the associated hydraulic motors (113) and (114) for driving the compressors, in addition to hydraulic motors (69) and (38). The engine has a hydraulic pump (111), which supplies the pressure to run the hydraulic motors and a hydraulic pilot pump (112), used to actuate the valve assembly. Each valve is controlled by a solenoid (not shown) which is controlled from the DCS for starting, stopping and modulating the flow rate. Multiple Filters (not Shown) are fitted in the tank on the discharge line, return line and pilot pump, together with high temperature shut downs (90), low level shut downs (91) and a sight glass for level indication (92). The tank can be filled and drained and has a first inspection ports (85) and a second inspection port (not shown) to allow for tank cleaning if needed.

In FIGS. 12*a* and 12*b* a hydraulic cooler (not shown) is mounted on the front of the engine radiator to provide a means by which the hydraulic fluid can be cooled. A bypass (not shown) is fitted around the cooler with a thermostat (not shown) to ensure that over cooling is not an issue. Hydraulic lines not shown are tied into a plate (97) recessed into the wall of the shelter structure, having unique connection points (98), to ensure there is no possibility of hooking lines up improperly providing hydraulic supplies to the compressor skid. A second plate is located on the compressor skid to provide a connection point for attaching the hydraulic lines (not shown).

The external connection points (98) are protected from damage, which could occur during shipping or during operation. A framework is preferably provided on the skid to support the ducting, DCS, hydraulic lines and the exhaust.

The exhaust system (93) is preferably a hospital grade exhaust muffler, located above the engine and inside the engine skid providing an exhaust elbow (101) to outside of the skid through the roof of the shelter structure.

A fuel scrubber (not shown) is used to provide a bridge from the high-pressure supply and to reduce the pressure for the engine. A second lip (118*a*) is placed around the skid to contain any leaks, which may happen.

In the present invention the engine skid is designed with the same principle as the compressor skid, using a sophisticated process and control system, and packaging it in such a way that someone with little to no training can operate and maintain it.

Both skids described above must be used in order to make this system operate. However it is possible to manufacture this system mounted on one skid only. The only change would be that the overall dimensions would become large, or the engine compartment would utilize intrinsically safe components. It is possible to create a compressor system with everything in one skid under one shelter structure, however it would probably be less economically efficient.

The skids are of an independent design. They can be placed on the ground outside any installation or they could be utilized inside a large building or installation area if desired. The skids are designed to be portable and the base simply acts as a means by which to support the structure. The shelter can be considered part of the skid, but the skid is self-supporting with a framework independent of the walls. The shelter is mainly used as a shell and to provide dampening of the sound waves emitted from the skids.

Although the present invention has been described as per a currently preferred embodiment, it is understood that the invention is not limited to this embodiment, since changes and modifications will be readily evident to those skilled in the art in the light of the preceding explanation. Therefore, the invention should be limited by the scope of the following claims.

The invention claimed is:

1. A natural gas compressor for optimizing the extraction of natural gas from a reservoir or associated gathering system, comprising in combination:

(a) a natural gas and liquids flow under pressure supply from a source;

(b) a separator, receiving the supply of gas and liquids flow under pressure by a first piping line and separating the natural gas and liquids flow into a gas flow and a liquids flow, the liquids flow directed to a drain and the gas flow directed to a second piping line;

(c) a water pump receiving the liquids flow from the drain by a draining line and conveying the liquids to any desired location;

(d) a compressor receiving the gas flow from the separator by the second piping line and compressing the gas;

(e) a compressor relief piping line, connected to the compressor for relieving any excessive pressure;

(f) an after-cooler receiving the compressed gas flow from the compressor by a third piping line, cooling the compressed gas flow and dividing the gas flow into a first cooled gas flow line, a second cooled gas flow line and a third cooled gas flow line;

(g) an engine, receiving the first cooled gas flow line from the after-cooler by a sixth piping line and generating power;

(h) an end-user connection receiving the second cooled gas flow line from the after-cooler by a fourth piping line;

(i) a low-pressure recycle line receiving the third cooled gas flow from the after-cooler by a fifth piping line and conveying to the end-user connection;

(j) an exhaust system exhausting the combustion gases from the engine;

(k) a hydraulic liquids supply from a source;

(l) a hydraulic pump, connected to the hydraulic liquids supply and to the engine, receiving power from the engine and transferring hydraulic pressure to a seventh piping line;

(m) a hydraulic motor, connected to the hydraulic liquids supply, to the hydraulic pump, to the engine and controlled by an actuated valve, receiving hydraulic pressure from the hydraulic pump by the seventh piping line and power from the engine; transferring power to the compressor, to the after-cooler and to the water pump by a hydraulic pumping system;

(n) a sensor and actuator assembly connected to predetermined and specific locations in the compressor;

(o) a valve assembly linked to the first, second, third, fourth, fifth, sixth and seventh piping lines, to the separator, to the water pump, to the compressor, to the after-cooler, to the low-pressure line, to the engine, to the hydraulic motor and to the hydraulic pumping system;

the valve assembly constructed and arranged to automatically controlling and operating the compressor within predetermined ranges of pressure, temperature and flow volume;

(p) a hydraulic pilot pump, connected to the hydraulic liquids supply and to the engine, receiving power from the engine and actuating the valve assembly;

(q) a computer readable system linked to the sensor and actuator and valve assemblies, to the hydraulic pump, to the hydraulic motor, to the engine, to the separator, to the compressor, to the after-cooler, to the low-pressure line, and to the hydraulic pumping system; the computer readable system constructed and arranged to allow for human-machine interface, and to simultaneously run and control the overall operation of the compressor system, and to allow for the operation of all components through the utilization of one power generating engine source, wherein the piping lines, the valve assembly, the hydraulic pump, the hydraulic motor, the engine, the separator, the compressor, the after-cooler and the low-pressure line are constructed and arranged to allow for a safe and easy removal and installation of any specific component and to allow for multiple functions to be undertaken at one time, accommodating a multitude of operational conditions.

2. The natural gas compressor according to claim 1, comprising an accessible sheltered compressor skid with a first shelter and an accessible sheltered engine skid with a second shelter hydraulically connected to each other.

3. The natural gas compressor according to claim 2, comprising two compressors.

4. The natural gas compressor according to claim 3, wherein the compressor skid comprises the natural gas and liquids flow under pressure supply; the separator; the first, second, third, fourth and fifth piping line; the compressors; the compressor relief piping line; the water pump; the draining line; the after -cooler; the low-pressure line, and wherein the engine skid comprises the engine, the exhaust system, a hydraulic liquids supply, the hydraulic pump and the hydraulic motor, and wherein the compressor and the engine skids are connected through the sensor and actuator assembly, the hydraulic pilot pump, the sixth piping line, the hydraulic pumping system, the valve assembly, and the computer readable system.

5. The natural gas compressor according to claim 3, wherein the first and second shelters includes a base, four parallel vertical walls and a roof structure.

6. The natural gas compressor according to claim 5, wherein the compressor and the engine are mounted on sled and track assemblies on the base of the skids.

7. The natural gas compressor according to claim 3, wherein the first piping line includes downstream:

a 3" 300 ansi connection;

a 3" ball valve; a check valve;

a 3" valve, and a first electric actuator of the sensor and actuator assembly.

8. The natural gas compressor according to claim 3, wherein the drain further includes a sight glass.

9. The natural gas compressor according to claim 3, wherein the second piping line includes downstream:

a first back-pressure valve;

a first and a second pressure sensors and of the sensor and actuator assembly, located upstream and downstream respectively of the first back-pressure valve;

a first piped T-shaped connector dividing the separated gas flow line into a first and a second divided flow lines;

a second piped T-shaped connector, dividing the first flow line into first two 2" lines;

first and second suction hoses installed in the first two 2" lines;

multiple drains located on the first two 2" lines;

a third piped T-shaped connector, dividing the second flow line into second two 2" lines;

third and fourth suction hoses installed in the second two 2" lines, and multiple drains located on the second two 2" lines.

10. The natural gas compressor according to claim 3, wherein the third piping line includes:

a first and a second expelling hose;

a first and a second temperature sensor of the sensor and actuator assembly, respectively installed downstream to the first and the second expelling hose;

a common fifth 2" pipe combining the gas flows from the first and the second expelling hose;

a third pressure sensor of the sensor and actuator assembly located on the common fifth 2" pipe, and a pressure safety valve located on the common fifth 2" pipe.

11. The natural gas compressor according to claim 3, further including a cooler fan, powered by a second hydraulic motor, attached to a fan shaft by way of a coupler.

12. The natural gas compressor according to claim 3, wherein the compressor skid further comprises:

a ducting, having a top and a bottom;

two recycle louvers and located on the top and bottom of the ducting;

an outlet louver;

a second electric actuator of the sensor and actuator assembly;

a linkage, located on the outlet of the ducting, linking the recycle louvers and connected to the electric actuator;

a temperature sensor located on the base;

multiple louvers located on the first shelter, and multiple hoods attached on the outside of the multiple louvers.

13. The natural gas compressor according to claim 3, wherein the sixth piping line includes:

a discharge pipe located downstream;

a fifth temperature sensor of the sensor and actuator assembly located downstream;

a first gas line, having a first manual valve, a second ball valve and a third electric actuator of the sensor and actuator assembly, conveying a first gas flow to the engine;

a second gas line, having a second back-pressure valve fitted with a bypass line, a pressure safety valve constructed and arranged to allow for a path to depressurize and purge the system and recycle high pressure gas back to separator;

a third gas line, having a discharge back-pressure valve, fitted with a bypass line, conveying a third gas flow to a gas meter, to a second check valve, to a buy-back line, to a manual ball valve, and to a second ball valve located on a discharge line;

a water valve, connected to the third gas line;

a connection, connected to the buy-back line, and a flare line, having a third manual valve, connected to the connection.

14. The natural gas compressor according to claim 13, wherein the buy-back line conveys a buy-back gas flow from the low-pressure recycle line to the separator providing fuel pressure for initial start-up of the compressor, if necessary.

15. The natural gas compressor according to claim 3, wherein the draining line connected to the water pump includes:

a fourth 2" pipe, leading to a basket strainer;

an upstream valve and a downstream valve connected to the strainer;

a pressure safety valve connected to the water pump;

a fourth pressure sensor;

a low flow switch;

a third back-pressure valve;

a water meter;

a third check valve, and an isolation valve.

16. The natural gas compressor according to claim 3, wherein the engine skid further comprises:

a radiator, connected to the engine;

multiple ducts, attached to the radiator, and equipped with an internal louver each;

the computer readable software, connected to the engine;

an exhaust system with an insulated covering;

a hydraulic tank, fitted with multiple filters and having supply lines and, a return line, a fill spout, a case drain, a valve bank, a high temperature shut down, a low level shut down, a sight glass for level indication, a first inspection port, and a second inspection port;

the hydraulic pump, supplying pressure to run the first hydraulic motors and the hydraulic pilot pump;

second, third, fourth and fifth hydraulic motors driving the compressor;

the hydraulic pilot pump, actuating the valve assembly, each valve controlled by a solenoid;

a hydraulic cooler, mounted on the front of the engine radiator;

a bypass, fitted around the cooler, and a thermostat.

17. The natural gas compressor according to claim 3, wherein the engine skid further comprises:

multiple hydraulic lines, tied into a plate recessed into the second shelter structure, having suitable connection points, constructed and arranged to ensure suitable hooking lines.

18. The natural gas compressor according to claim 3, further comprising an exhaust system located above the engine.

19. The natural gas compressor according to claim 18, wherein the exhaust system is a hospital grade exhaust muffler.

20. The natural gas compressor according to claim 3, wherein the sensor and actuator assembly include pressure and temperature sensors.

21. The natural gas compressor according to claim 3, wherein the sensor and actuator assembly include electrical actuators.

22. The natural gas compressor according to claim 3, wherein the compressors includes an inter-cooler.

23. The natural gas compressor according to claim 3, wherein the engine skid further includes a governor.

24. A method for operating the natural gas compressor of claim 1, the method comprising:

(1) providing the gas and liquids flow under pressure to the separator;

(2) separating the gas and the liquids in the flow;

(3) conveying the separated gas flow from the separator to the compressor;

(4) conveying the separated liquids flow from the separator to the water pump;

(5) conveying the separated liquids flow from the water pump to the any desired location, draining any remaining liquids;

(6) compressing the gas;

(7) conveying the compressed gas flow from the compressor to the after-cooler;

(8) cooling the gas flow from the compressor;

(9) conveying a first flow of the separated cooled gas flow from the after-cooler to the engine, the engine generating power;

(10) conveying a second flow of the separated cooled gas flow from the after-cooler to the end-user connection;

(11) conveying a third flow of the separated cooled gas flow to the low-pressure recycle line, the low-pressure recycle line conveying the third flow of the separated cooled gas flow to the end-user connection;

(12) supplying hydraulic liquid and the power generated by the engine to the hydraulic pump;

(13) transferring hydraulic power from the hydraulic pump to the hydraulic motor and to the hydraulic pilot pump;

(14) transferring hydraulic power from the hydraulic motor to the compressor;

(15) obtaining operational information from the sensor assembly and transmitting to the computer readable system;

(16) the computer readable system comparing the obtained operational information with predetermined operational parameters; the computer readable system activating the valve assembly, actuated by the hydraulic pilot pump; the valve assembly activating the actuator assembly and automatically controlling and adjusting the natural gas compressor to operate within the predetermined operational parameters.

25. The method for operating a natural gas compressor according to claim 24, wherein in the step of separating the gas and the liquids in the flow, the liquids are directed to a drain in the base of the separator, through gravity, and the gas is directed to a set of valves and sensor through the top of the separator, the sensor sending a pressure value to the computer readable program.

26. The method for operating a natural gas compressor according to claim 24, comprising two compressors.

27. The method for operating a natural gas compressor according to claim 26, wherein in the step of conveying the separated gas flow from the separator to the compressors the gas flow is divided and then two gas flows are provided into a first stage of each of the compressors.

28. The method for operating a natural gas compressor according to claim 27, wherein the two gas flows are compressed from the first stage to a second stage of the compressors through inter-coolers, and conveyed through a first and a second temperature sensor, the first and second sensor communicating a temperature value to the computer readable system.

29. The method for operating a natural gas compressor according to claim 24, further including the step of activating a cooler fan, through a second hydraulic motor in the compressor skid.

30. The method for operating a natural gas compressor according to claim 24, wherein in the event that the room temperature falls, an electric actuator is activated opening recycle louvers and controlling the temperature.

31. The method for operating a natural gas compressor according to claim 24, wherein in the step (9) of conveying a first flow of the separated cooled gas flow from the after-cooler to an engine, the gas flow is conveyed from the after-cooler through a fuel line.

32. The method for operating a natural gas compressor according to claim 24, wherein in the step (10) of conveying a second flow of the separated cooled gas flow from the after-cooler to an end-user connection, the gas flow through a set of valves and meters and through a discharge line.

33. The method for operating a natural gas compressor according to claim 32, further including conveying a buy-back line flow of cooled gas to the separator through a buy-back line, the buy-back line conveying the buy-back line flow of the separated cooled gas flow, from the third flow back to the separator providing fuel pressure for initial start-up of the compressor, if necessary.

34. The method for operating a natural gas compressor according to claim 33, further including conveying produced water flow to the gas line or to any desired location through a water valve, if necessary.

35. The method for operating a natural gas compressor according to claim 24, wherein the compressors can be removed by uncoupling hydraulic hoses, removing bolts, unbolting connections on the compressor, and sliding compressors out of the shelter.

36. The method for operating a natural gas compressor according to claim 24, wherein the compressors can be installed by sliding the compressors into the shelter, connecting hydraulic hoses to the compressors, and bolting bolts.

* * * * *